US008863714B1

(12) United States Patent
Moran et al.

(10) Patent No.: US 8,863,714 B1
(45) Date of Patent: Oct. 21, 2014

(54) CAMSHAFT ASSEMBLY

(71) Applicant: GM Global Technology Operations LLC, Detroit, MI (US)

(72) Inventors: Robert J. Moran, Ann Arbor, MI (US); Hans-Guido Kemmer, Frankfurt (DE); Kevin M. Luchansky, Sterling Heights, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 0 days.

(21) Appl. No.: 14/047,494

(22) Filed: Oct. 7, 2013

Related U.S. Application Data

(60) Provisional application No. 61/866,184, filed on Aug. 15, 2013.

(51) Int. Cl.
*F01L 1/34* (2006.01)
*F01L 13/00* (2006.01)

(52) U.S. Cl.
CPC ..... *F01L 13/0036* (2013.01)
USPC ..... 123/90.18; 123/90.16; 123/90.44; 29/888.1

(58) Field of Classification Search
USPC ..... 123/90.16, 90.18, 90.44; 29/888.1
See application file for complete search history.

(56) References Cited

U.S. PATENT DOCUMENTS

| | | | | |
|---|---|---|---|---|
| 7,162,983 | B1 * | 1/2007 | Raghavan et al. | 123/90.16 |
| 2011/0226205 | A1 | 9/2011 | Kraus | |

FOREIGN PATENT DOCUMENTS

| | | | |
|---|---|---|---|
| DE | 4230877 | A1 | 4/1993 |
| DE | 102007010151 | A1 | 4/2008 |
| DE | 102007010154 | A1 | 6/2008 |
| DE | 102007010155 | A1 | 9/2008 |
| DE | 102007061353 | A1 | 6/2009 |
| DE | 102009022657 | A1 | 1/2011 |
| DE | 102010022708 | A1 | 12/2011 |
| DE | 102010025099 | A1 | 12/2011 |
| DE | 102011115533 | A1 | 4/2013 |
| DE | 102011085707 | A1 | 5/2013 |
| WO | 2012110069 | A1 | 8/2012 |
| WO | 2013001069 | A1 | 1/2013 |

* cited by examiner

*Primary Examiner* — Ching Chang
(74) *Attorney, Agent, or Firm* — Quinn Law Group, PLLC

(57) ABSTRACT

A camshaft assembly includes a base shaft extending along a longitudinal axis. The base shaft is configured to rotate about the longitudinal axis. The camshaft assembly further includes a series of lobe packs mounted on the base shaft. The lobe pack includes a first cam lobe, a second cam, and a third cam lobe. The lobe pack further includes a barrel cam defining a control groove. The camshaft assembly further includes an actuator including an actuator body and at least one pin movably coupled to the actuator body. The lobe pack is configured to move axially relative to the base shaft between a first position, a second position, and a third position. These three lobe pack positions are used to define three discrete valve lift profiles for the intake or exhaust valves in the cylinder. The lift profiles can be different for each engine valve.

20 Claims, 17 Drawing Sheets

CAMSHAFT ASSEMBLY

CROSS-REFERENCE TO RELATED APPLICATIONS

This application claims the benefit of U.S. Provisional Application 61/866,184, filed Aug. 15, 2013, which is hereby incorporated by reference in its entirety.

TECHNICAL FIELD

The present disclosure relates to a camshaft assembly for an engine assembly.

BACKGROUND

Vehicles typically include an engine assembly for propulsion. The engine assembly may include an internal combustion engine defining one or more cylinders. In addition, the engine assembly may include intake valves for controlling the flow of an air/fuel mixture into the cylinders and exhaust valves for controlling the flow of exhaust gases out of the cylinders. The engine assembly may further include a valvetrain system for controlling the operation of the intake and exhaust valves. The valvetrain system includes a camshaft assembly for moving the intake and exhaust valves.

SUMMARY

The present disclosure relates to a camshaft assembly capable of controlling the operation of the exhaust and intake valves of an internal combustion engine. The optimal operation of the intake and exhaust valves may depend on one or more engine operating conditions such as the engine speed. It is therefore useful to vary the valve lift of the intake and exhaust valves depending on the engine operating conditions. As used herein, the term "valve lift" means the maximum distance that an intake or exhaust valve can travel from a closed position to an open position. The presently disclosed camshaft assembly can adjust the valve lift of the intake and exhaust valves. The camshaft assembly can control the valve lift and valve lift profile in three discrete steps for each valve in the engine.

In an embodiment, the camshaft assembly includes a base shaft extending along a longitudinal axis. The base shaft is configured to rotate about the longitudinal axis. The camshaft assembly further includes a lobe pack for each cylinder mounted on the base shaft. The lobe pack includes a first cam lobe, a second cam lobe axially spaced from the first cam lobe, and a third cam lobe axially spaced from the first and second cam lobes. The lobe pack further includes a barrel cam defining a control groove. The control groove includes a groove portion obliquely angled relative to the longitudinal axis. The camshaft assembly further includes an actuator including an actuator body and first and second pins movably coupled to the actuator body. Each of the first and second pins is configured to move relative to the actuator body between a retracted position and an extended position. The lobe pack is configured to move axially relative to the base shaft between a first position and a second position when the base shaft rotates about the longitudinal axis and the first pin is in the extended position and at least partially disposed in the groove portion of the control groove. Further, the lobe pack is configured to move axially between a second position and a third position when the base shaft rotates about the longitudinal axis and the second pin is in the extended position and at least partially disposed in the groove portion of the control groove.

In another embodiment, the camshaft assembly includes a base shaft extending along a longitudinal axis. The base shaft is configured to rotate about the longitudinal axis. The camshaft assembly further includes a lobe pack for each cylinder mounted on the base shaft. The lobe pack includes a first cam lobe, a second cam lobe axially spaced from the first cam lobe, and a third cam lobe axially spaced from the first and second cam lobes. The lobe pack further includes a barrel cam defining first and second control grooves. The first control groove includes a first angled groove portion obliquely angled relative to the longitudinal axis. The second control groove includes a second angled groove portion obliquely angled relative to the longitudinal axis. The camshaft assembly further includes an actuator including an actuator body and a pin movably coupled to the actuator body. The pin is configured to move relative to the actuator body between a retracted position and an extended position. The lobe pack is configured to move axially relative to the base shaft between a first position and a second position when the base shaft rotates about the longitudinal axis and the pin is in the extended position and at least partially disposed in the first angled groove portion of the first control groove. The lobe pack is configured to move axially relative to the base shaft between the second position and a third position when the base shaft rotates about the longitudinal axis and the pin is in the extended position and at least partially disposed in the second angled groove portion of the second control groove.

The present disclosure also relates to vehicles. In an embodiment, the vehicle includes an internal combustion engine defining a combustion chamber and a port, such as an intake port or an exhaust port, in fluid communication with the combustion chamber. The internal combustion engine further includes a valve, such as an intake valve or an exhaust valve, at least partially disposed in the port. The vehicle further includes a base shaft operatively coupled to the internal combustion engine. The base shaft extends along a longitudinal axis and is configured to rotate about the longitudinal axis. The vehicle further includes a lobe pack mounted on the base shaft. The lobe pack is configured to move axially relative to the base shaft between a first position, a second position, and a third position. The lobe pack includes a first cam lobe configured to be operatively coupled to the valve when the lobe pack is in the first position. Further, the lobe pack includes a second cam lobe axially spaced from the first cam lobe. The second cam lobe is configured to be operatively coupled to the valve when the lobe pack is in the second position. The lobe pack further includes a third cam lobe axially spaced from the first and second cam lobes. The third cam lobe is configured to be operatively coupled to the valve when the lobe pack is in the third position. The lobe pack further includes a barrel cam defining a control groove. The control groove includes a groove portion obliquely angled relative to the longitudinal axis. The vehicle further includes an actuator including an actuator body and first and second pins movably coupled to the actuator body. Each of the first and second pins is configured to move relative to the actuator body between a retracted position and an extended position. The lobe pack is configured to move axially between the first and second positions when the base shaft rotates about the longitudinal axis and the first pin is in the extended position and at least partially disposed in the groove portion of the control groove. The lobe pack is configured to move axially between the second and third positions when the base shaft rotates about the longitudinal axis and the second pin is in the extended position and at least partially disposed in the groove portion of the control groove.

The above features and advantages, and other features and advantages, of the present invention are readily apparent from the following detailed description of some of the best modes and other embodiments for carrying out the invention, as defined in the appended claims, when taken in connection with the accompanying drawings.

DETAILED DESCRIPTION

Figure 1:
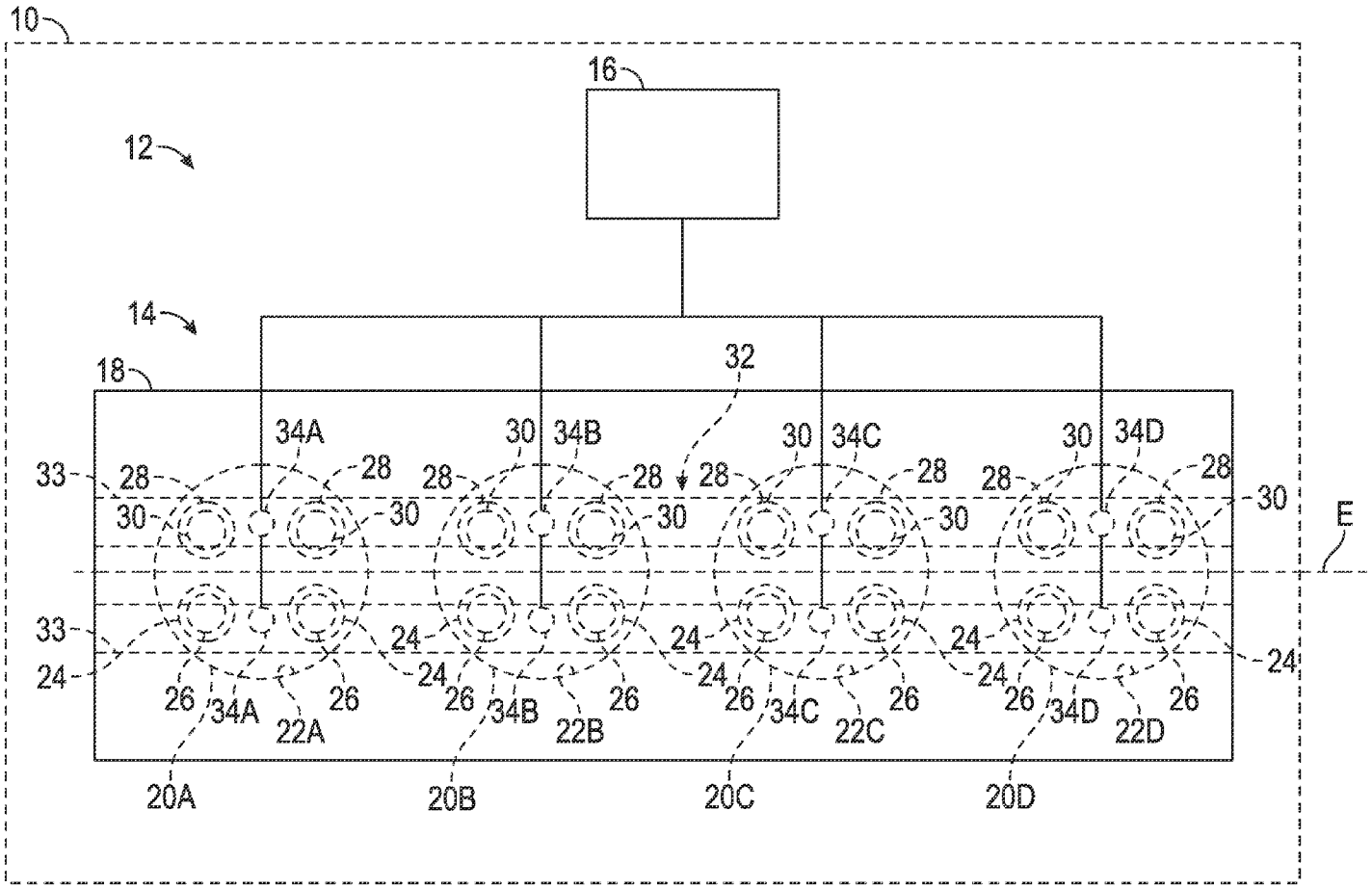
FIG. 1 is a schematic diagram of a vehicle including an engine assembly.

Referring to the drawings, wherein like reference numbers correspond to like or similar components throughout the several figures, FIG. 1 schematically illustrates a vehicle 10 such as a car, truck or motorcycle. The vehicle 10 includes an engine assembly 12. The engine assembly 12 includes an internal combustion engine 14 and a control module 16, such an engine control module (ECU), in electronic communication with the internal combustion engine 14. The terms "control module," "module," "control," "controller," "control unit," "processor" and similar terms mean any one or various combinations of one or more of Application Specific Integrated Circuit(s) (ASIC), electronic circuit(s), central processing unit(s) (preferably microprocessor(s)) and associated memory and storage (read only, programmable read only, random access, hard drive, etc.) executing one or more software or firmware programs or routines, combinational logic circuit(s), sequential logic circuit(s), input/output circuit(s) and devices, appropriate signal conditioning and buffer circuitry, and other components to provide the described functionality. "Software," "firmware," "programs," "instructions," "routines," "code," "algorithms" and similar terms mean any controller executable instruction sets including calibrations and look-up tables. The control module 16 may have a set of control routines executed to provide the desired functions. Routines are executed, such as by a central processing unit, and are operable to monitor inputs from sensing devices and other networked control modules, and execute control and diagnostic routines to control operation of actuators. Routines may be executed based on events or at regular intervals.

The internal combustion engine 14 includes an engine block 18 defining a plurality of cylinders 20A, 20B, 20C, and 20D. In other words, the engine block 18 includes a first cylinder 20A, a second cylinder 20B, a third cylinder 20C, and a fourth cylinder 20E. Although FIG. 1 schematically illustrates four cylinders, the internal combustion engine 14 may include more or fewer cylinders. The cylinders 20A, 20B, 20C, and 20D are spaced apart from each other but may be substantially aligned along an engine axis E. Each of the cylinders 20A, 20B, 20C, and 20D is configured, shaped and sized to receive a piston (not shown). The pistons are configured to reciprocate within the cylinders 20A, 20B, 20C, and 20D. Each cylinders 20A, 20B, 20C, 20D defines a corresponding combustion chamber 22A, 22B, 22C, 22D. During operation of the internal combustion engine 14, an air/fuel mixture is combusted inside the combustion chambers 22A, 22B, 22C, and 22D in order to drive the pistons in a reciprocating manner. The reciprocating motion of the pistons drives a crankshaft (not shown) operatively connected to the wheels (not shown) of the vehicle 10. The rotation of the crankshaft can cause the wheels to rotate, thereby propelling the vehicle 10.

In order to propel the vehicle 10, an air/fuel mixture should be introduced into the combustion chambers 22A, 22B, 22C, and 22D. To do so, the internal combustion engine 14 includes a plurality of intake ports 24 fluidly coupled to an intake manifold (not shown). In the depicted embodiment, the internal combustion engine 14 includes two intake ports 24 in fluid communication with each combustion chamber 22A, 22B, 22C, and 22D. However, the internal combustion engine 14 may include more or fewer intake ports 24 per combustion chamber 22A, 22B, 22C, and 22D. The internal combustion chamber 14 includes at least one intake port 24 per cylinder 20A, 20B, 20C, 20D.

The internal combustion engine 14 further includes a plurality of intake valves 26 configured to control the flow of the air/fuel mixture through the intake ports 24. The number of intake valves 26 corresponds to the number of intake ports 24. Each intake valve 26 is at least partially disposed within a corresponding intake port 24. In particular, each intake valve 26 is configured to move along the corresponding intake port 24 between an open position and a closed position. In the closed position, the intake valve 26 allows the air/fuel mixture to enter a corresponding combustion chamber 22A, 22B, 22C, or 22D via the corresponding intake port 24. Conversely, in the closed position, the intake valve 26 precludes the air/fuel mixture from entering the corresponding combustion chamber 22A, 22B, 22C, or 22D via the intake port 24.

As discussed above, the internal combustion engine 14 can combust the air/fuel mixture once the air/fuel mixture enters the combustion chamber 22A, 22B, 22C, or 22D. For example, the internal combustion engine 14 can combust the air/fuel mixture in the combustion chamber 22A, 22B, 22C, or 22D using an ignition system (not shown). This combustion generates exhaust gases. To expel these exhaust gases, the internal combustion engine 14 defines a plurality of exhaust ports 28. The exhaust ports 28 are in fluid communication with the combustion chambers 22A, 22B, 22C, or 22D. In the depicted embodiment, two exhaust ports 28 are in fluid communication with each combustion chamber 22A, 22B, 22C, or 22D. However, more or fewer exhaust ports 28 may be fluidly coupled to each combustion chamber 22A, 22B, 22C, or 22D. The internal combustion engine 14 includes at least one exhaust port 28 per cylinder 20A, 20B, 20C, or 20D.

The internal combustion engine 14 further includes a plurality of exhaust valves 30 in fluid communication with the combustion chambers 22A, 22B, 22C, or 22D. Each exhaust valve 30 is at least partially disposed within a corresponding exhaust port 28. In particular, each exhaust valve 30 is configured to move along the corresponding exhaust port 28 between an open position and a closed position. In the open position, the exhaust valve 30 allows the exhaust gases to escape the corresponding combustion chamber 22A, 22B, 22C, or 22D via the corresponding exhaust port 28. The vehicle 10 may include an exhaust system (not shown) configured to receive and treat exhaust gases from the internal combustion engine 14. In the closed position, the exhaust valve 30 precludes the exhaust gases from exiting the corresponding combustion chamber 22A, 22B, 22C, or 22D via the corresponding exhaust port 28.

The engine assembly 12 further includes a valvetrain system 32 configured to control the operation of the intake valves 26 and exhaust valves 30. Specifically, the valvetrain system 32 can move the intake valves 26 and exhaust valves 30 between the open and closed positions based at least in part on the operating conditions of the internal combustion engine 14 (e.g., engine speed). The valvetrain system 32 includes one or more camshaft assemblies 33 substantially parallel to the engine axis E. In the depicted embodiment, the valvetrain system 32 includes two camshaft assemblies 33. One camshaft assembly 33 is configured to control the operation of the intake valves 26, and the other camshaft assembly 33 can control the operation of the exhaust valves 30. It is contemplated, however, that the valvetrain system 32 may include more or fewer camshaft assemblies 33.

In addition to the camshaft assemblies 33, the valvetrain assembly 32 includes a plurality of actuators 34A, 34B, 34C, and 34D, such as solenoids, in communication with the control module 16. The actuators 34A, 34B, 34C, and 34C may be electronically connected to the control module 16 and may therefore be in electronic communication with the control module 16. The control module 16 may be part of the valvetrain system 32. In the depicted embodiment, the valvetrain system 32 includes first actuators 34A, second actuators 34B, third actuators 34C, and fourth actuators 34C. The first actuators 34A are operatively associated with the first cylinder 20A. As such, the first and second actuators 34A and 34B can be actuated to control the operation of the intake valves 26 and exhaust valves 30 of the first and second cylinders 20A and 20B. The third and fourth actuators 34C and 34D are operatively associated with the third and fourth cylinders 20C and 20D. As such, the third actuators 34C and 34D can be actuated to control the operation of the intake valves 26 and exhaust valves 30 of the third and fourth cylinders 20C and 20D. The actuators 34A, 34B, 34C, 34D and control module 16 may be deemed part of the camshaft assembly 33.

Figure 2:
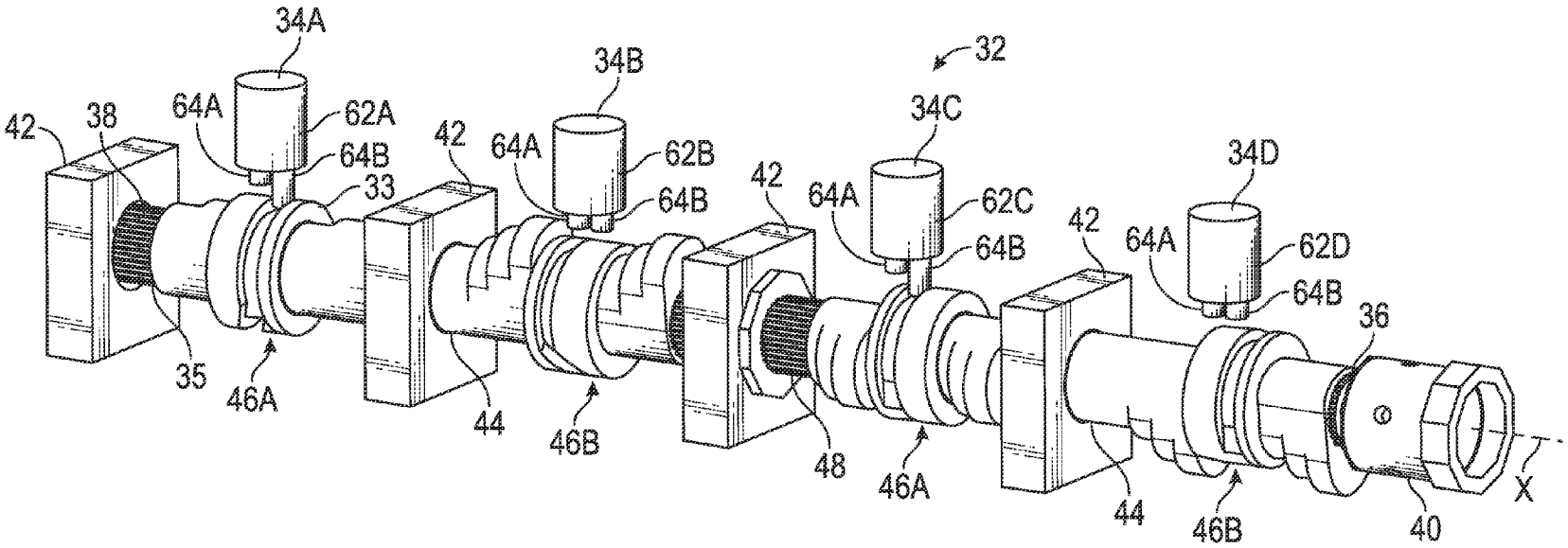
FIG. 2 is a schematic perspective view of a camshaft assembly of the engine assembly of FIG. 1 in accordance with an embodiment of the present disclosure.

With reference to FIG. 2, the valvetrain system 32 includes the camshaft assembly 33 and the actuators 34A, 34B, 34C, and 34D as discussed above. The camshaft assembly 33 includes a base shaft 35 elongated along a longitudinal axis X. The base shaft 35 may also be referred to as the support shaft and includes a first shaft end portion 36 and a second shaft end portion 38 opposite the first shaft end portion 36.

Moreover, the camshaft assembly 33 includes a coupler 40 connected to the first shaft end portion 36 of the base shaft 35. The coupler 40 can be used to operatively couple the base shaft 35 to the crankshaft (not shown) of the engine 14. The crankshaft of the engine 14 can drive the base shaft 35. Accordingly, the base shaft 35 can rotate about the longitudinal axis X when driven by, for example, the crankshaft of the engine 14. The rotation of the base shaft 35 causes the entire camshaft assembly 33 to rotate about the longitudinal axis X. The base shaft 35 is therefore operatively coupled to the internal combustion engine 14.

The camshaft assembly 33 may additionally include one or more bearings 42, such as journal bearings, coupled to a fixed structure, such as the engine block 18. The bearings 42 may be spaced apart from one another along the longitudinal axis. X. In the depicted embodiment, the camshaft assembly 33 includes four bearings 42. It is envisioned, however, that the camshaft assembly 33 may include more or fewer bearings 42. At least one bearing 42 may be at the second shaft end portion 38.

The camshaft assembly 33 further includes one or more axially movable members 44 mounted on the base shaft 35. The axially movable members 44 are configured to move axially relative to the base shaft 35 along the longitudinal axis X. However, the axially movable members 44 are rotationally fixed to the base shaft 35. Consequently, the axially movable members 44 rotate concomitantly with the base shaft 35. The base shaft 35 may include a spline feature 48 for maintaining angular alignment of the lobe pack 46A and 46B to the base shaft 35 and also for transmitting drive torque between the base shaft 35 and the lobe packs 46A and 46B.

In the depicted embodiment, the camshaft assembly 33 includes two axially movable members 44. It is nevertheless contemplated that the camshaft assembly 33 may include more or fewer axially movable members 44. Regardless of the quantity, the axially movable members 44 are axially spaced apart from each other along the longitudinal axis X. The axially movable members 44 may also be referred to as sliding members because these members can slide along the base shaft 35.

Figure 3:
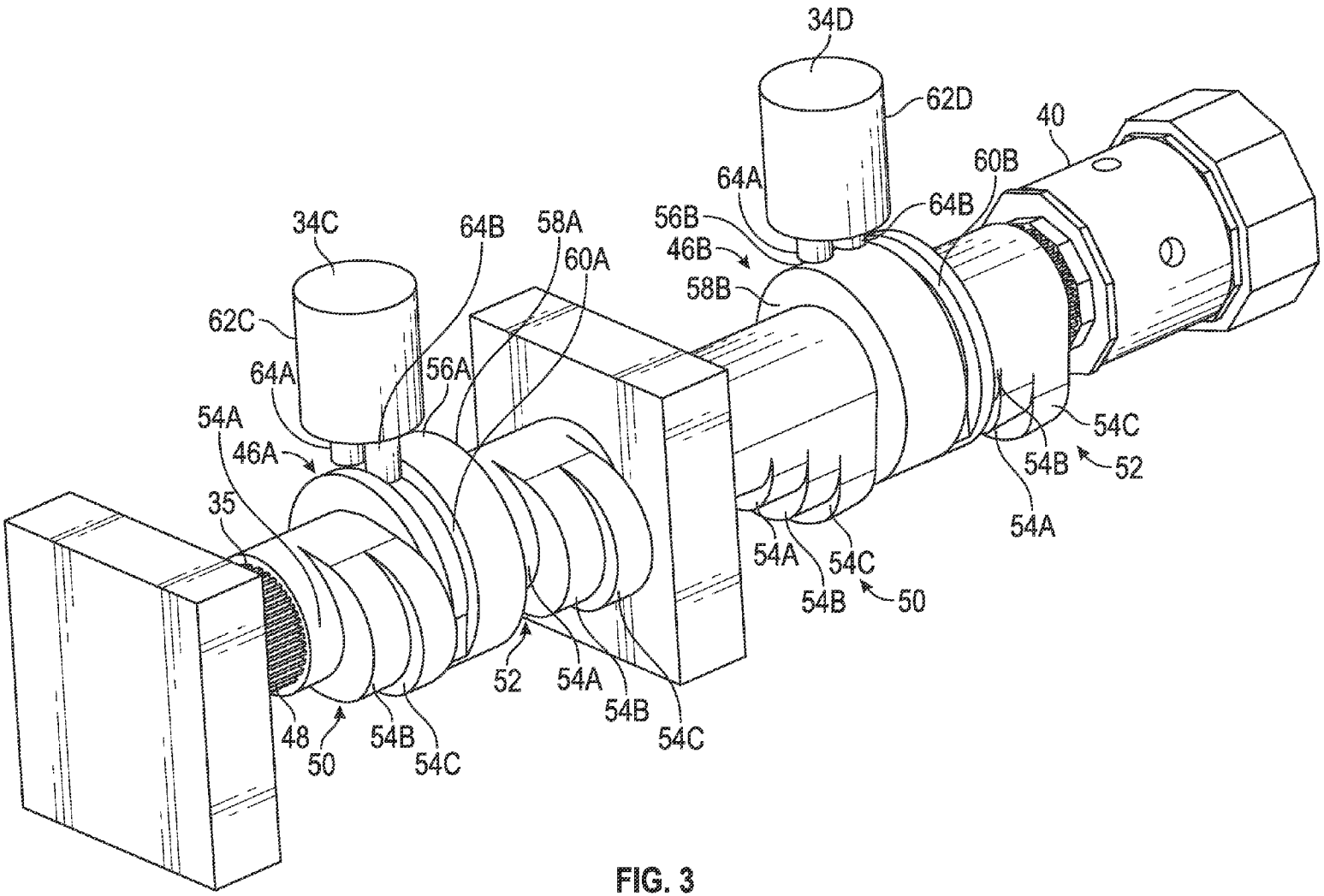
FIG. 3 is a schematic perspective view of a portion of the camshaft assembly of FIG. 2.

With specific reference to FIG. 3, each axially movable member 44 includes a first lobe pack 46A and a second lobe pack 46B coupled to each other. The first and second lobe packs 46A and 46B may also be referred to as cam packs. Each axially movable member 44 may be a monolithic structure. Accordingly, the first and second lobe packs 46A, 46B of the same axially movable member 44 can move simultaneously relative to the base shaft 35. The lobe packs 46A, 46B are nevertheless rotationally fixed to the base shaft 35. Consequently, the lobe packs 46A, 46B can rotate in unison with the base shaft 35. Though the drawings show that each axially movable member 44 includes two lobe packs 46A, 46B, each axially movable member 44 may include more or fewer lobe packs.

Each lobe pack 46A, 46B includes a first group of cam lobes 50, a second group of cam lobes 52, and a barrel cam 56A or 56B disposed between the first and second group of lobes 50, 52. The first lobe pack 46A includes the first barrel cam 56A, whereas the second lobe pack 46B includes the second barrel cam 56B. The first group of cam lobes 50, the second group of cam lobes 52, and the barrel cam 56A or 56B are axially spaced apart from each other along the longitudinal axis X. Specifically, the barrel cam 56A or 56B is axially disposed between the first and second group of cam lobes 50, 52.

Each group of cam lobes 50, 52 includes a first cam lobe 54A, a second cam lobe 54B, and a third cam lobe 54C. It is envisioned that each group of cam lobes 50, 52 may include more cam lobes. The cam lobes 54A, 54B, 54C have a typical cam lobe form with a profile that defines different valve lifts in three discrete steps. As a non-limiting example, one cam lobe profile may be circular (e.g., zero lift profile) in order to deactivate a valve (e.g., intake and exhaust valves 26, 30). The cam lobes 54A, 54B, 54C may have different lobe heights as discussed in detail below.

Each barrel cam 56A, 56B includes a barrel cam body 58A, 58B and defines a control groove 60A, 60B extending into the respective barrel cam body 58A, 58B. Each control groove 60A, 60B is elongated along at least a portion of the circumference of the respective barrel cam body 58A, 58B. Thus, each control groove 60A, 60B is circumferentially disposed along the respective barrel cam body 58A, 58B. Further, each control groove 60A, 60B is configured, shaped, and sized to interact with one of the actuators 34A, 34B, 34C, or 34D. As discussed in detail below, the interaction between the actuator 34A, 34B, 34C, or 34D causes the axially movable member 44 (and thus the lobe packs 46A, 46B) to move axially relative to the base shaft 35.

With reference to FIGS. 2 and 3, each actuator 34A, 34B, 34C, or 34D includes an actuator body 62A, 62B, 62C, 62D, and first and second pins 64A, 64B movably coupled to the actuator body 62A, 62B, 62C, 62D. The first and second pins 64A, 64B of each actuator 34A, 34B, 34C, 34D are axially spaced apart from each other and can move independently from each other. Specifically, each of the first and second pins 64A, 64B can move relative to the corresponding actuator body 62A, 62B, 62C, 62D between a retracted position and an extended position in response to an input or command from the control module 16 (FIG. 1). In the retracted position, the first or second pin 64A or 64B is not disposed in the control groove 60A or 60B. Conversely, in the extended position, the first or second pin 64A or 64B can be at least partially disposed in the control groove 60A or 60B. Accordingly, the first and second pins 64A, 64B can move toward and away from the control groove 60A or 60B of a corresponding barrel cam 56A, 56B in response to an input or command from the control module 16 (FIG. 1). Hence, the first and second pins 64A, 64B of each actuator 34A, 34B, 34C, 34D can move relative to a corresponding barrel cam 56A, 56B in a direction substantially perpendicular to the longitudinal axis X.

Figure 4:
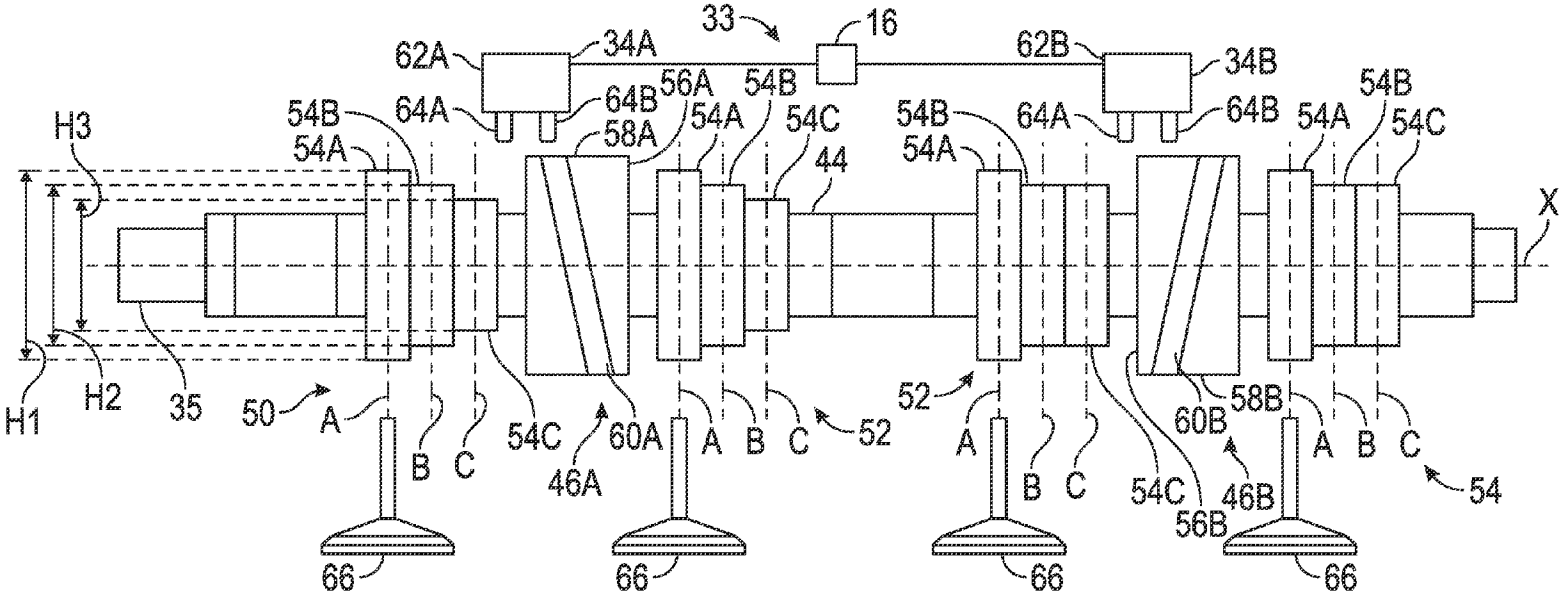
FIG. 4 is a schematic side view of a portion of the camshaft assembly in accordance with an embodiment of the present disclosure, showing the lobe packs of the camshaft assembly in a first position.

With reference to FIG. 4, the valvetrain system 32 (FIG. 1) includes a camshaft assembly 33. The camshaft assembly 33 shown in FIG. 4, although not identical, operates under the same principles as the camshaft assembly 33 shown in FIGS. 2 and 3. Though FIG. 4 shows only one axially movable member 44 having two lobe packs (e.g., the first and second lobe packs 46A, 46B that are operatively associated with two cylinders of the engine 14), it is contemplated that the camshaft assembly 33 may include more axially movable members 44. The axially movable member 44 may also include more or fewer than two lobe packs 46A, 46B. In other words, the axially movable member 44 may include at least one lobe pack 46A.

As discussed above, each lobe pack 46A, 46B includes a first group of cam lobes 50, a second group of cam lobes 52, and a barrel cam 56A, 56B disposed between the first and second group of lobe packs 50, 52. Each group of cam lobes 50, 52 includes a first cam lobe 54A, a second cam lobe 54B, and a third cam lobe 54C. The first cam lobe 54A may have a first maximum lobe height H1. The second cam lobe 54B has a second maximum lobe height H2. The third cam lobe 54C has a third maximum lobe height H3. The first, second, and third maximum lobe heights H1, H2, H3 may be different from one another. In the embodiment depicted in FIG. 4, the first, second, and third cam lobes 54A, 54B, 54C of the first lobe pack 46A have different maximum lobe heights, but the second and third cam lobes 54B, 54C of the second lobe pack 46B have the same maximum lobe heights. In other words, the third maximum lobe height H3 may be equal to the second maximum lobe height H2. Alternatively, the second maximum lobe height H2 may be different from the third maximum lobe height H3. The maximum lobe heights of the cam lobes 54A, 54B, 54C corresponds to the valve lift of the intake and exhaust valves 26, 30. The camshaft assembly 33 can adjust the valve lift of the intake and exhaust valves 26, 30 by adjusting the axial position of the cam lobes 54A, 54C, 54D relative to the base shaft 35. This can include a zero lift cam profile if desired.

The cam lobes 54A, 54B, 54C of each group of cam lobes 50, 52 are disposed in different axial positions along the longitudinal axis X. In the depicted embodiment, the first cam lobe 54A is at a first axial position A, the second cam lobe 54B is in a second axial position B, and the third cam lobe 54C is in a third axial position C along the longitudinal axis X.

Figure 5:
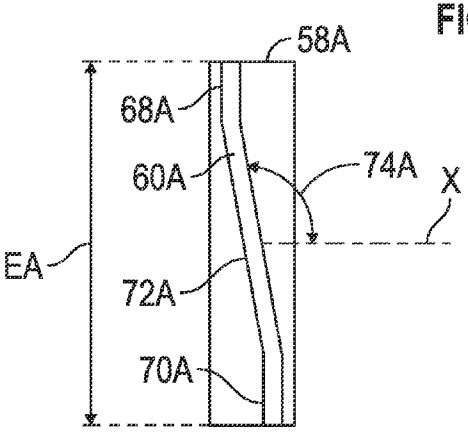
FIG. 5 is a schematic unwrapped view of a first barrel cam of the camshaft assembly shown in FIG. 4, depicting the entire arc length of a control groove of the first barrel cam.
Figure 10:
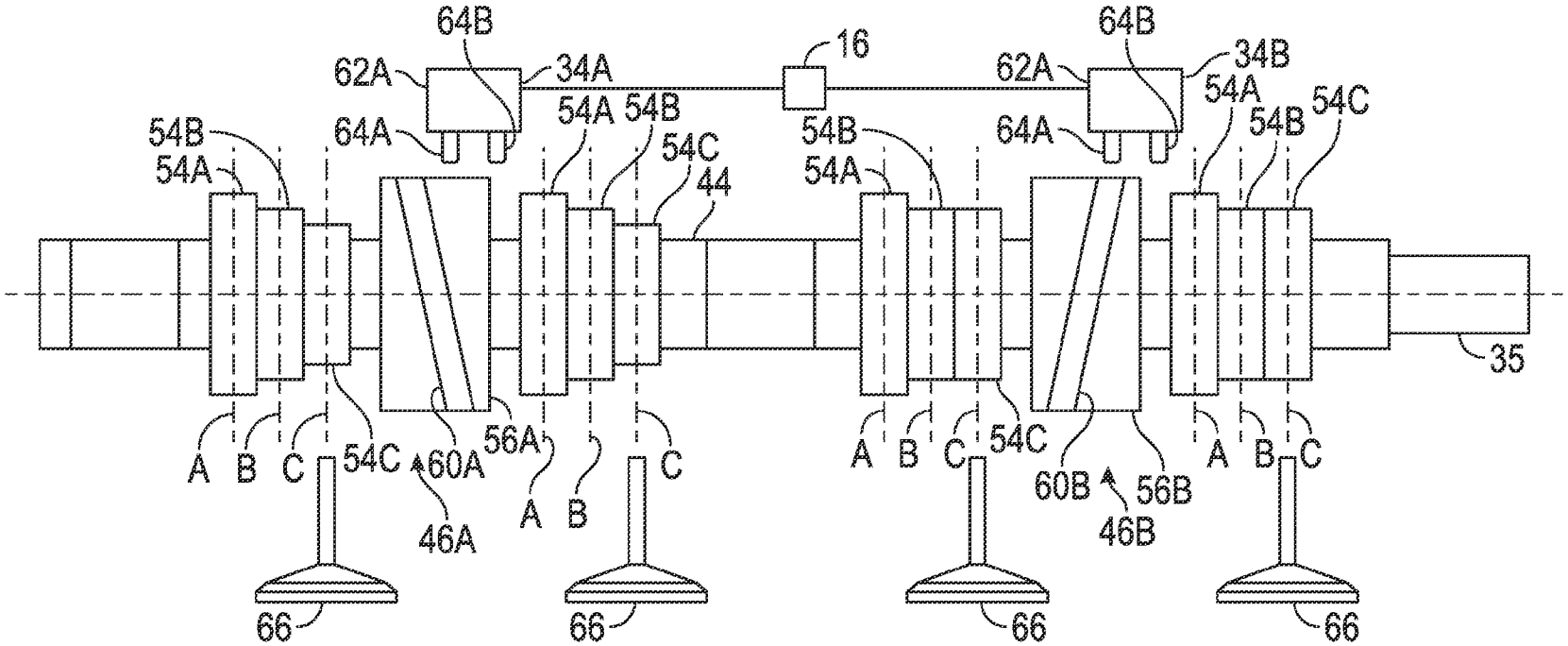
FIG. 10 is a schematic side view of the camshaft assembly shown in FIG. 4, showing the lobe packs in a third position.

With reference to FIGS. 4-5, the lobe pack 46A, 46B can move relative to the base shaft 35 between a first position (FIG. 4), a second position (FIG. 8), and a third position (FIG. 10). To do so, the barrel cams 56A, 56B can physically interact with the actuators 34A, 34B, respectively. As discussed above, each barrel cam 56A, 56B includes a barrel cam body 58A, 58B and defines a control groove 60A, 60B extending into the barrel cam body 58A, 58B. Each control groove 60A, 60B is elongated along at least a portion of the circumference of the respective barrel cam body 58A, 58B.

FIG. 5 schematically illustrates the entire control groove 60A (in a rectified state), thereby showing the entire arc length EA of the control groove 60A of the first barrel cam 56A. The control groove 60A includes a first groove portion 68A, a second groove portion 70A, and a third groove portion 72A disposed between the first groove portion 68A and second groove portion 70A. The first groove portion 68A is axially spaced from the second groove portion 70A and is substantially perpendicular to the longitudinal axis X. The second groove portion 72A is also substantially perpendicular to the longitudinal axis X. The third groove portion 72A interconnects the first groove portion 68A and second groove portion 70A and is obliquely angled relative to the longitudinal axis X. Specifically, the third groove portion 72A defines a first oblique angle 74A relative to the longitudinal axis X. During operation of the camshaft assembly 33, the lobe packs 46A, 46B can move axially relative to the base shaft 35 when one of the actuator pins 64A, 64B is disposed in the third groove portion 72A and the base shaft 35 is rotating. The shape of the control groove 72A and 72B is illustrated as a simple oblique profile; however the shape of the control grooves 72A and 72B can also be contoured as required to control the axial movement of the lobe pack 46A or 46B. The form of the control grooves 72A and 72B defines the velocity and force associated with the axial movement of the lobe packs 46A or 46B. After moving the lobe packs 4A, 46B, the lobe packs 46A, 46B can be maintained in a fixed axial position relative to the base shaft 35 by a detent feature. Specifically, the base shaft 35 includes a detent feature (e.g., ball and spring, riding in groove) that is used to maintain the lobe packs 46A, 46B at a fixed axial position relative to the base shaft 35 when none of the actuator pins 64A, 64B are in the extended position.

Figure 6:
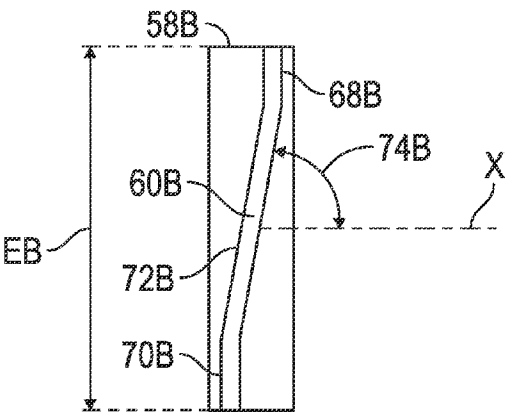
FIG. 6 is a schematic unwrapped view of a second barrel cam of the camshaft assembly shown in FIG. 4, depicting the entire arc length of a control groove of the second barrel cam.

FIG. 6 schematically illustrates the entire control groove 60B (in a rectified state), thereby showing the entire arc length EB of the control groove 60B of the second barrel cam 56B. The control groove 60B includes a first groove portion 68B, a second groove portion 70B, and a third groove portion 72B disposed between the first groove portion 68B and second groove portion 70B. The first groove portion 68B is axially spaced from the second groove portion 70B and is substantially perpendicular to the longitudinal axis X. The second groove portion 72B is also substantially perpendicular to the longitudinal axis X. The third groove portion 72B interconnects the first groove portion 68B and second groove portion 70B and is obliquely angled relative to the longitudinal axis X. Specifically, the third groove portion 72B defines a second oblique angle 74B relative to the longitudinal axis X. The second oblique angle 74B is different from the first oblique angle 74A. For example, the first oblique angle 74A may be less than the second oblique angle 74B. During operation of the camshaft assembly 33, the lobe packs 46A, 46B can move axially relative to the base shaft 35 when one of the actuator pins 64A, 64B is disposed in the third groove portion 72B and the base shaft 35 is rotating.

In FIG. 4, the axially movable member 44 is in a first position relative to the base shaft 35. When the axially movable member 44 is in the first position relative to the base shaft 35, the lobe packs 46A, 46B are in the first position and, the first cam lobe 54A of each lobe pack 46A, 46B is substantially aligned with the engine valves 66 (see first axial position A). The engine valves 66 represent intake or exhaust valves 26, 30 as described above. In the first position, the first cam lobes 54A are operatively coupled to the engine valves 66. As such, the engine valves 66 have a valve lift that corresponds to the first maximum lobe height H1, which is herein referred to as a first valve lift. In other words, when the lobe packs 46A, 46B are in the first position, the engine valves 66 have a first valve lift, which corresponds to the first maximum lobe height H1.

During operation, the axially movable member 44 and the lobe packs 46A, 46B can move between a first position (FIG. 4), a second position (FIG. 8) and a third position (FIG. 10) to adjust the valve lift of the engine valves 66. As discussed above, in the first position (FIG. 4), the first cam lobes 54A are substantially aligned with the engine valves 66. The rotation of the lobe pack 46A, 46B causes the engine valves 66 to move between the open and closed positions. When the lobe packs 46A, 46B are in the first position (FIG. 4), the valve lift of the engine valves 46 may be proportional to the first maximum lobe height H1.

Figure 7:
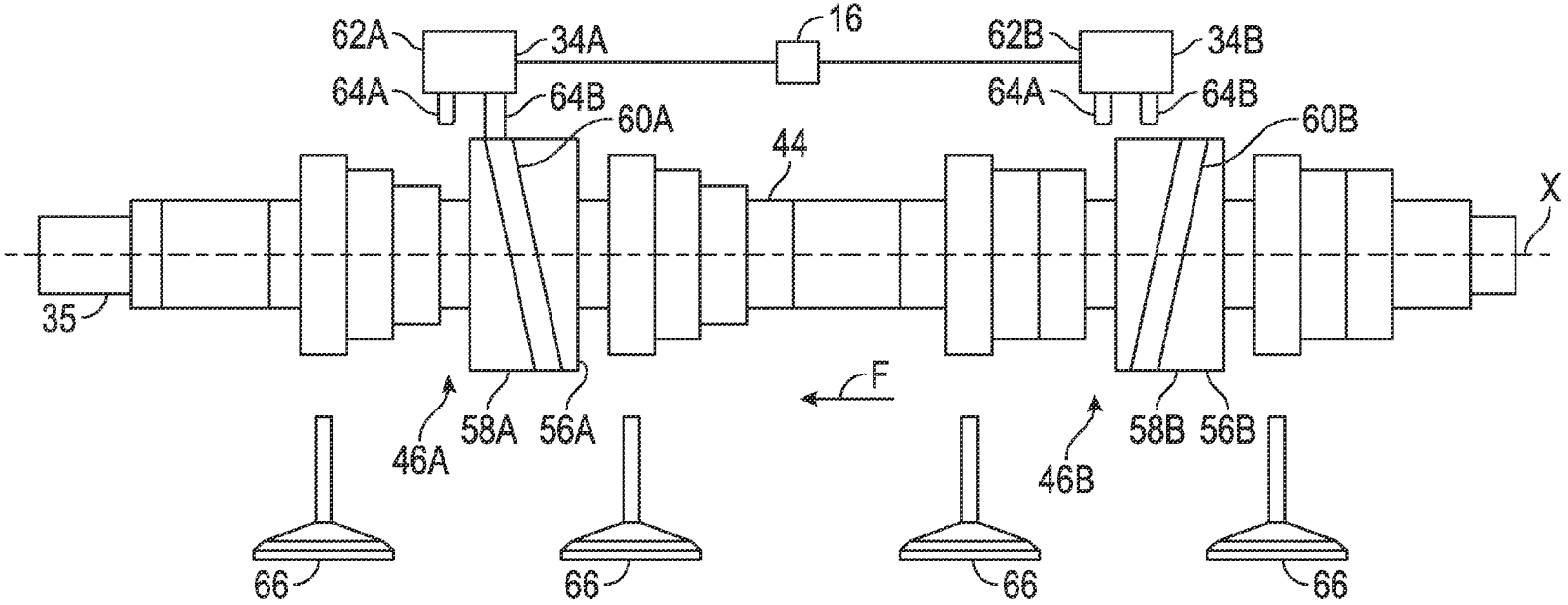
FIG. 7 is a schematic side view of the camshaft assembly shown in FIG. 4, showing a first pin of a first actuator in an extended position.

To move the axially movable member 44 from the first position (FIG. 4) to the second position (FIG. 8), the control module 16 can command the first actuator 34A to move its second pin 64B from the retracted position to the extended position while the base shaft 35 rotates about the longitudinal axis X as shown in FIG. 7. In the extended position, the second pin 64B is at least partially disposed in the control groove 60A. The control groove 60A is therefore configured, shaped, and sized to receive the second pin 64B when the second pin 64B is in the extended position. At this point, the second pin 64B of the first actuator 34A partially enters the first groove portion 68A of the control groove 60A and then rides along the third groove portion 72A as the lobe packs 46A, 46B rotate about the longitudinal axis X. As the second pin 64B rides along the third groove portion 72A (FIG. 5) of the control groove 60A, the axially movable member 44 and the lobe packs 46A, 46B move axially relative to the base shaft 35 from the first position (FIG. 4) to the second position (FIG. 8) in a first direction F. The second pin 64B of the first actuator 34A will be retracted mechanically by the control groove 60A. After the lobe packs 46A, 46B have moved, the depth of the control groove 60A is reduced in order to return the second pin 64B back to the retracted position. Alternatively, the control module 16 can command the first actuator 34A to move the second pin 64B to the retracted position.

Figure 8:
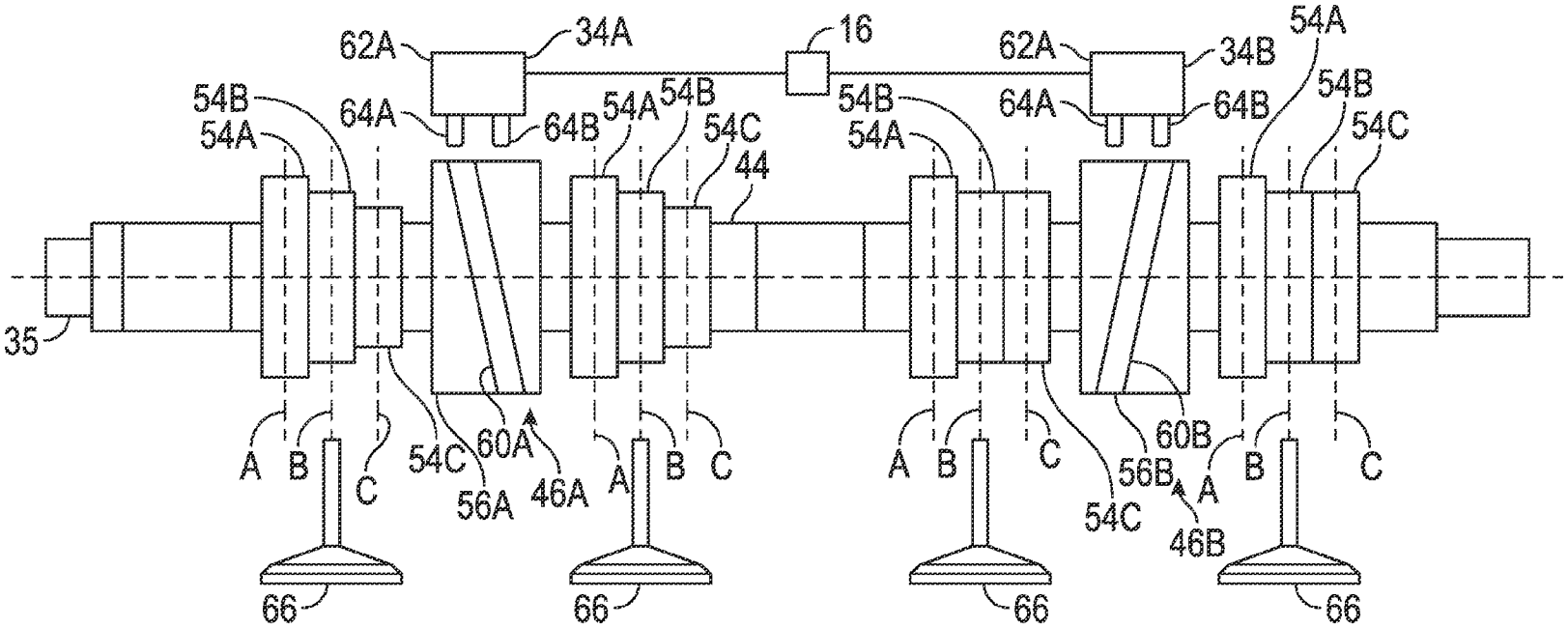
FIG. 8 is a schematic side view of the camshaft assembly shown in FIG. 4, showing the lobe packs in a second position.

In FIG. 8, the axially movable member 44 is in a second position relative to the base shaft 35. When the axially movable member 44 is in the second position relative to the base shaft 35, the lobe packs 46A, 46B are in the second position and, the second cam lobe 54B of each lobe pack 46A, 46B is substantially aligned with the engine valves 66 (see second axial position B). The engine valves 66 represent intake or exhaust valves 26, 30 as described above. In the second position, the second cam lobes 54B are operatively coupled to the engine valves 66. As such, the engine valves 66 have a valve lift that corresponds to the second maximum lobe height H2 (FIG. 4), which is herein referred to as a second valve lift. In other words, when the lobe packs 46A, 46B are in the second position, the engine valves 66 have a second valve lift, which corresponds to the second maximum lobe height H2.

Figure 9:
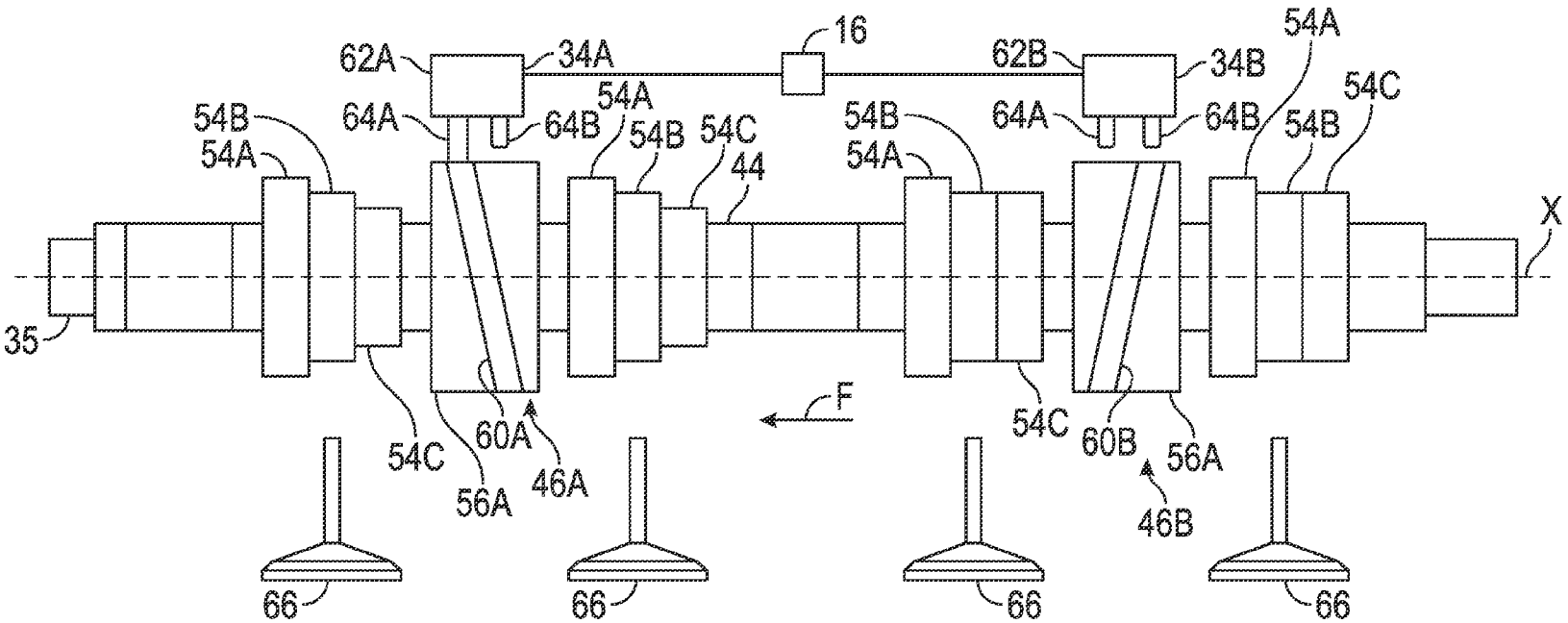
FIG. 9 is a schematic side view of the camshaft assembly shown in FIG. 4, showing a second pin of a second actuator in an extended position.

To move the axially movable member 44 from the second position (FIG. 8) to the third position (FIG. 10), the control module 16 can command the first actuator 34A to move its first pin 64A from the retracted position to the extended position while the base shaft 35 rotates about the longitudinal axis X as shown in FIG. 9. In the extended position, the first pin 64A is at least partially positioned in the control groove 60A. The control groove 60A is therefore configured, shaped, and sized to receive the first pin 64A when the first pin 64A is in the extended position. At this point, the first pin 64A of the first actuator 34A partially enters the first groove portion 68A (FIG. 5) of the control groove 60A and then rides along the third groove portion 72A (FIG. 5) as the lobe packs 46A, 46B rotate about the longitudinal axis X. As the first pin 64A rides along the third groove portion 72A of the control groove 60A, the axially movable member 44 and the lobe packs 46A, 46B move axially relative to the base shaft 35 from the second position (FIG. 8) to the third position (FIG. 10) in the first direction F. The first pin 64A of the first actuator 34A will be retracted mechanically by the control groove 60A. After the lobe packs 46A, 46B have moved, the depth of the control groove 60A is reduced in order to return the first pin 64A back to the retracted position. Alternatively, the control module 16 can command the first actuator 34A to move the first pin 64A to the retracted position.

In FIG. 10, the axially movable member 44 is in a third position relative to the base shaft 35. When the axially movable member 44 is in the third position relative to the base shaft 35, the lobe packs 46A, 46B are in the third position and the third cam lobe 54C of each lobe pack 46A, 46B is substantially aligned with the engine valves 66 (see third axial position C). The engine valves 66 represent intake or exhaust valves 26, 30 as described above. In the third position, the third cam lobes 54C are operatively coupled to the engine valves 66. As such, the engine valves 66 have a valve lift that corresponds to the third maximum lobe height H3 (FIG. 4), which is herein referred to as a third valve lift. In other words, when the lobe packs 46A, 46B are in the third position, the engine valves 66 have a third valve lift, which corresponds to the third maximum lobe height H3. The third cam lobes 54C of the first and second lobe packs 46A, 46B may have different maximum lobe heights.

Figure 11:
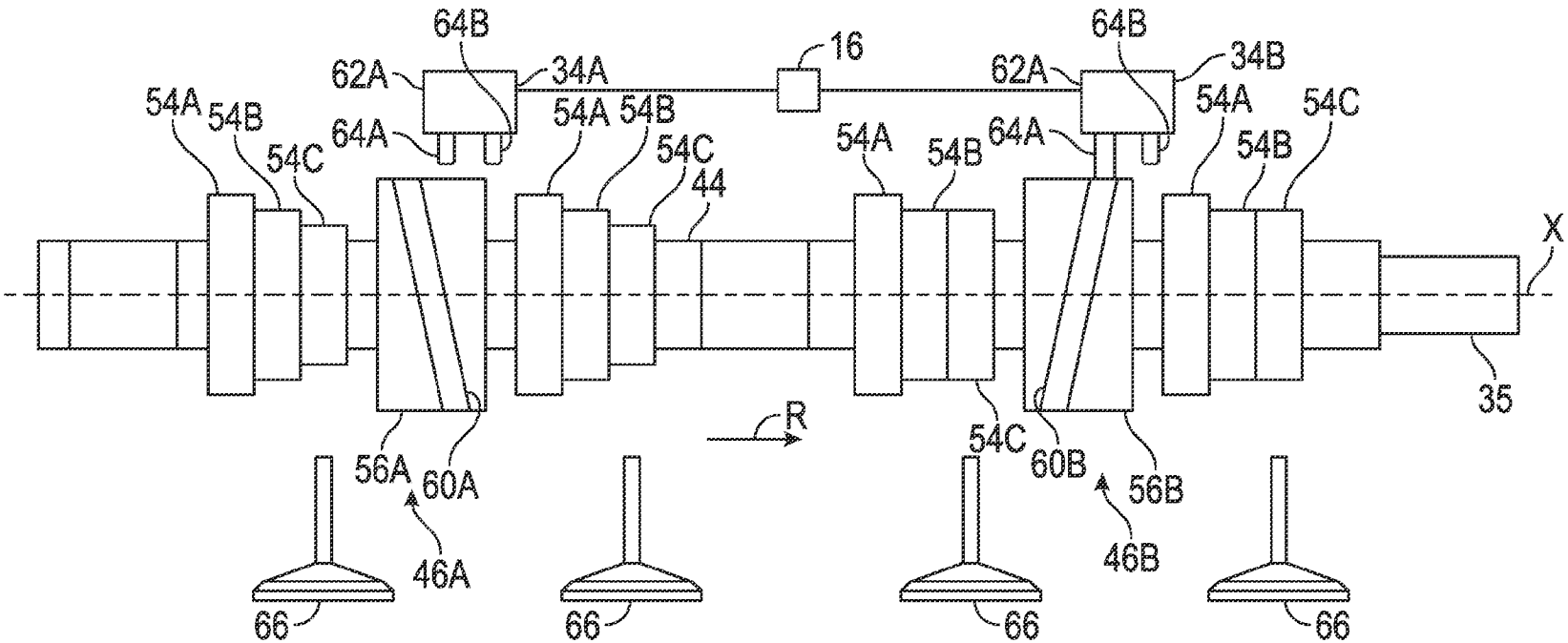
FIG. 11 is a schematic side view of the camshaft assembly shown in FIG. 4, showing a first pin of a second actuator in an extended position.

To move the axially movable member 44 from the third position (FIG. 10) to the second position (FIG. 8), the control module 16 can command the second actuator 34B to move its first pin 64A from the retracted position to the extended position while the base shaft 35 rotates about the longitudinal axis X as shown in FIG. 11. In the extended position, the first pin 64A is at least partially positioned in the control groove 60B. The control groove 60B is therefore configured, shaped, and sized to receive the first pin 64A when the first pin 64A is in the extended position. At this point, the first pin 64A of the second actuator 34B partially enters the first groove portion 68B (FIG. 6) of the control groove 60B and then rides along the third groove portion 72B (FIG. 6) as the lobe packs 46A, 46B rotate about the longitudinal axis X. As the first pin 64A rides along the third groove portion 72B (FIG. 6) of the control groove 60B, the axially movable member 44 and the lobe packs 46A, 46B move axially relative to the base shaft 35 from the third position (FIG. 10) to the second position (FIG. 8) in a second direction R. The first pin 64A of the second actuator 34B will be retracted mechanically by the control groove 60B. After the lobe packs 46A, 46B have moved, the depth of the control groove 60B is reduced in order to return the first pin 64A back to the retracted position. Alternatively, the control module 16 can command the second actuator 34B to move the first pin 64A to the retracted position.

Figure 12:
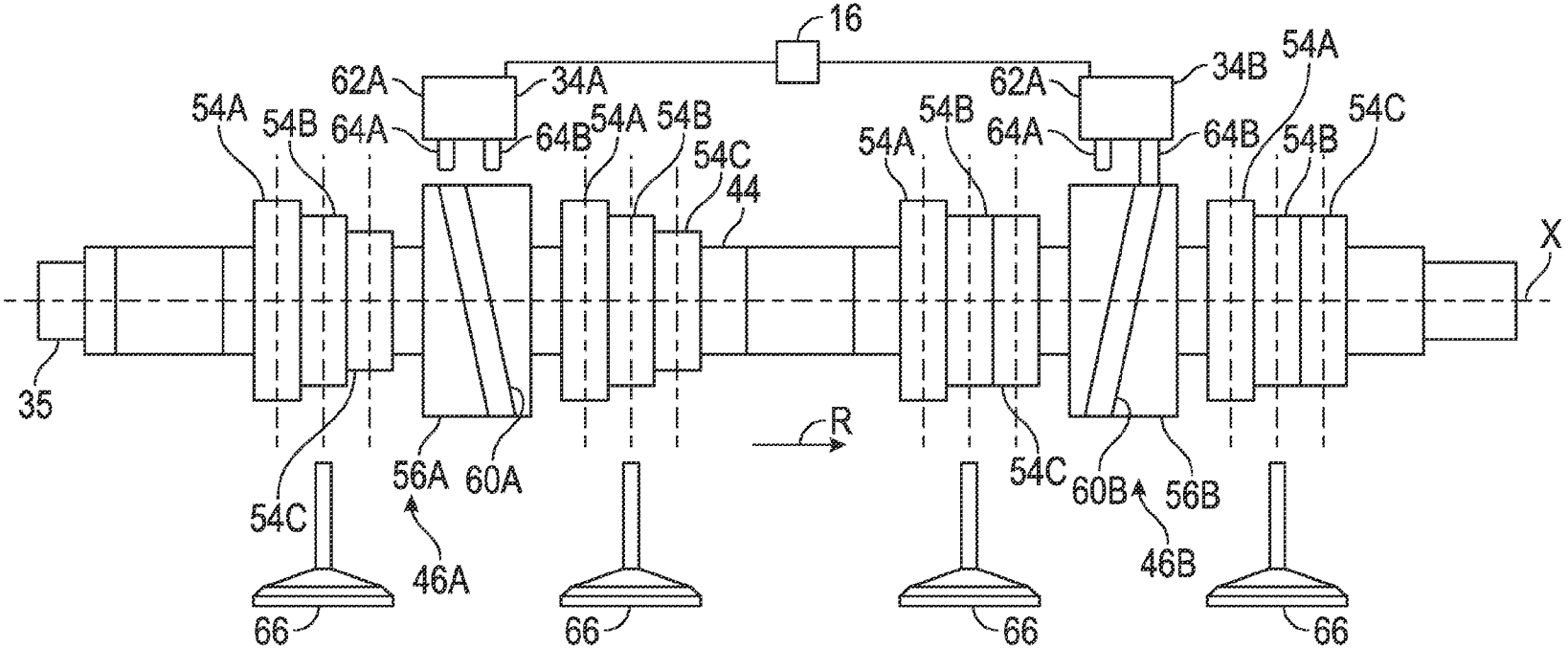
FIG. 12 is a schematic side view of the camshaft assembly shown in FIG. 4, showing a second pin of the second actuator in an extended position.

To move the axially movable member 44 from the second position (FIG. 8) to the first position (FIG. 4), the control module 16 can command the second actuator 34B to move its second pin 64B from the retracted position to the extended position while the base shaft 35 rotates about the longitudinal axis X as shown in FIG. 12. In the extended position, the second pin 64B is at least partially positioned in the control groove 60B. The control groove 60B is therefore configured, shaped, and sized to receive the second pin 64B when the second pin 64B is in the extended position. At this point, the second pin 64B of the second actuator 34B partially enters the first groove portion 68B of the control groove 60B and then rides along the third groove portion 72B as the lobe packs 46A, 46B rotate about the longitudinal axis X. As the second pin 64B rides along the third groove portion 72B of the control groove 60B, the axially movable member 44 and the lobe packs 46A, 46B move axially relative to the base shaft 35 from the second position (FIG. 8) to the first position (FIG. 4) in the second direction R. The second pin 64B of the second actuator 34B will be retracted mechanically by the control groove 60B. After the lobe packs 46A, 46B have moved, the depth of the control groove 60B is reduced in order to return the first pin 64A back to the retracted position. Alternatively, the control module 16 can command the first actuator 34A to move the second pin 64B to the retracted position.

Figure 13:
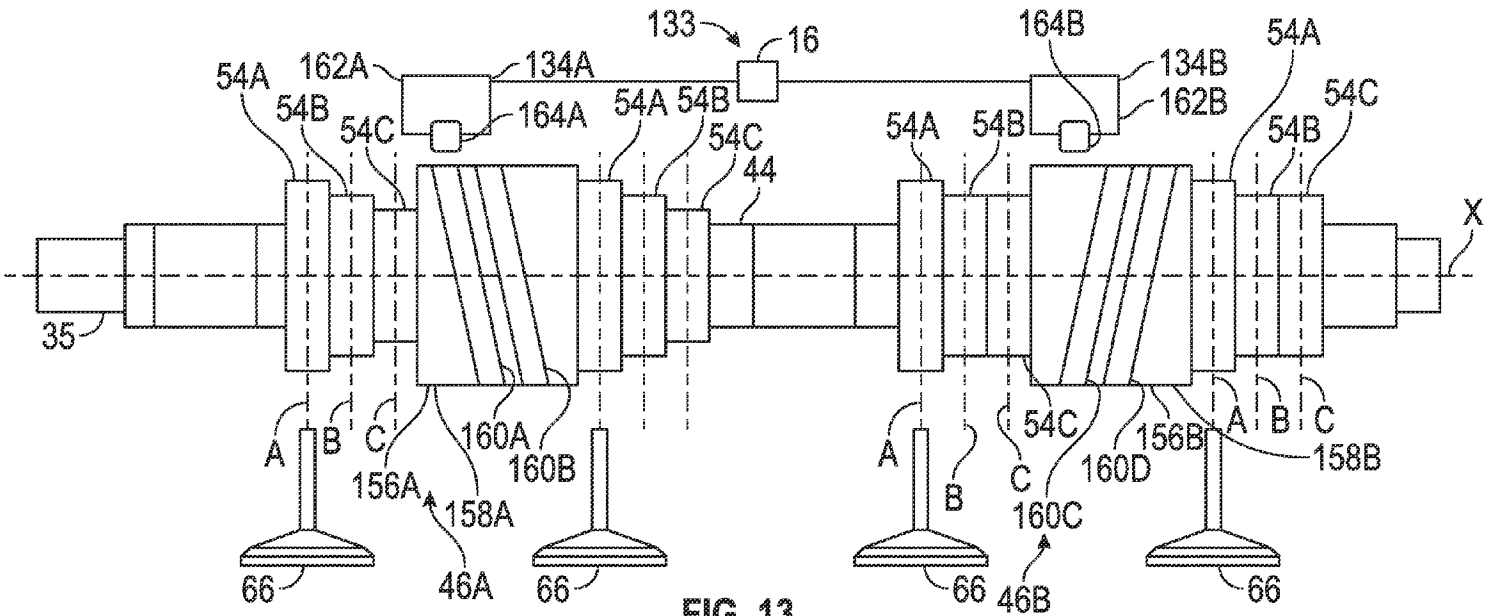
FIG. 13 is a schematic side view of a camshaft assembly in accordance with another embodiment of the present disclosure, showing the lobe packs of the camshaft assembly in a first position.

FIG. 13 schematically illustrates a camshaft assembly 133 in accordance with another embodiment of the present disclosure. The structure and operation of the camshaft assembly 133 is similar to the structure and operation of the camshaft assembly 33 described above. In the interest of brevity, the difference between the camshaft assembly 133 and the camshaft assembly 33 shown in FIG. 4 are described below. Specifically, the camshaft assembly 133 includes different barrel cams 156A, 156B and different actuators 134A, 134B.

With continued reference to FIG. 13, the camshaft assembly 133 includes first and second actuators 134A, 134B each having a single pin 164A, 164B. In particular, the first actuator 134A includes a first actuator body 162A and only one pin 164A movably coupled to the first actuator body 162A. The pin 164A of the first actuator 134A may be referred to as the first pin and can move relative to the first actuator body 162A between a refracted position and an extended position in response to a command or input from the control module 16. Similarly, the second actuator 134B includes a second actuator body 162B and only one pin 164B movably coupled to the second actuator body 162B. The pin 164B of the second actuator 134B may be referred to as the second pin and can move relative to the second actuator body 162B between a retracted position and an extended position in response to a command or input from the control module 16.

The camshaft assembly 133 further includes first and second barrel cams 156A, 156B. The first barrel cam 156A includes a first barrel cam body 158A and defines a first and second control grooves 160A, 160B disposed circumferentially along the first barrel cam body 158A. In other words, the first cam barrel cam 156A includes two control grooves 160A, 160B. The second barrel cam 156B includes a second barrel cam body 158B and defines third and fourth control grooves 160C, 160B disposed circumferentially along the second barrel cam body 158B. In other words, the second barrel cam 158B includes two control grooves 160C, 160D.

Figure 14:
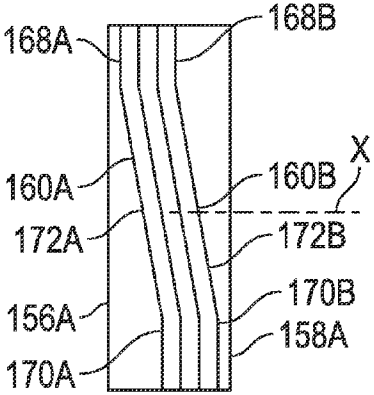
FIG. 14 is a schematic unwrapped view of a first barrel cam of the camshaft assembly shown in FIG. 13, depicting the entire arc length of the first and second control grooves of the first barrel cam.

FIG. 14 schematically illustrates the entire control grooves 160A, 160B (in a rectified state) of the first barrel cam 156A. Although disposed in the same barrel cam 156A, the control grooves 160A, 160B do not intersect. Each of the control grooves 160A, 160B includes a first groove portion 168A, 168B, a second groove portion 170A 170B, and a third groove portion 172A, 172B. The third groove portions 172A, 172B are obliquely angled relative to the longitudinal axis X and, as such, may be referred to as the angled groove portions. Specifically, the groove portion 172A may be referred to as a first angled groove portion and the groove portion 172B may be referred to as a second angled groove portion.

Figure 15:
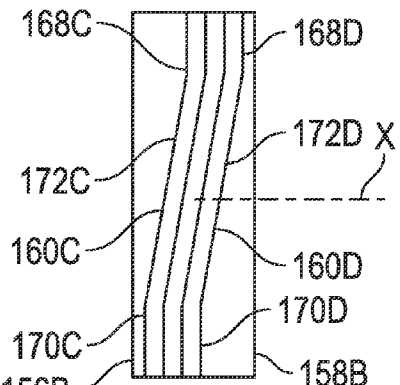
FIG. 15 is a schematic unwrapped view of a second barrel cam of the camshaft assembly shown in FIG. 13, depicting the entire arc length of the first and second control grooves of the second barrel cam.

FIG. 15 schematically illustrates the entire control grooves 160C, 160D (in a rectified state) of the second barrel cam 156B. Although disposed in the same barrel cam 156B, the control grooves 160C, 160D do not intersect. Each of the control grooves 160C, 160D includes a first groove portion 168C, 168D, a second groove portion 170C 170D, and a third groove portion 172C, 172D. The third groove portions 172A, 172B are obliquely angled relative to the longitudinal axis X and, as such, may be referred to as the angled groove portions. Specifically, the groove portion 172C may be referred to as a third angled groove portion and the groove portion 172D may be referred to as a fourth angled groove portion.

Figure 16:
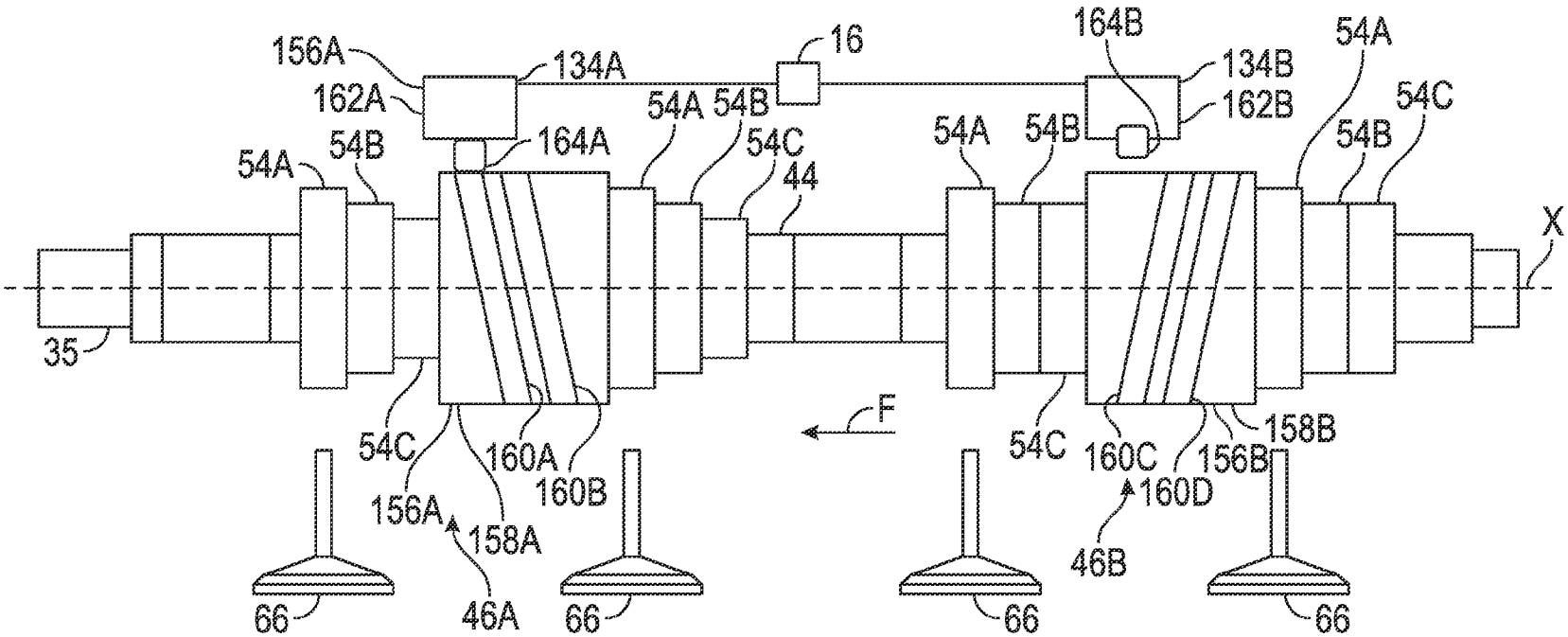
FIG. 16 is a schematic side view of the camshaft assembly shown in FIG. 13, showing a first actuator with a pin partially disposed in the first control groove of the first barrel cam.
Figure 17:
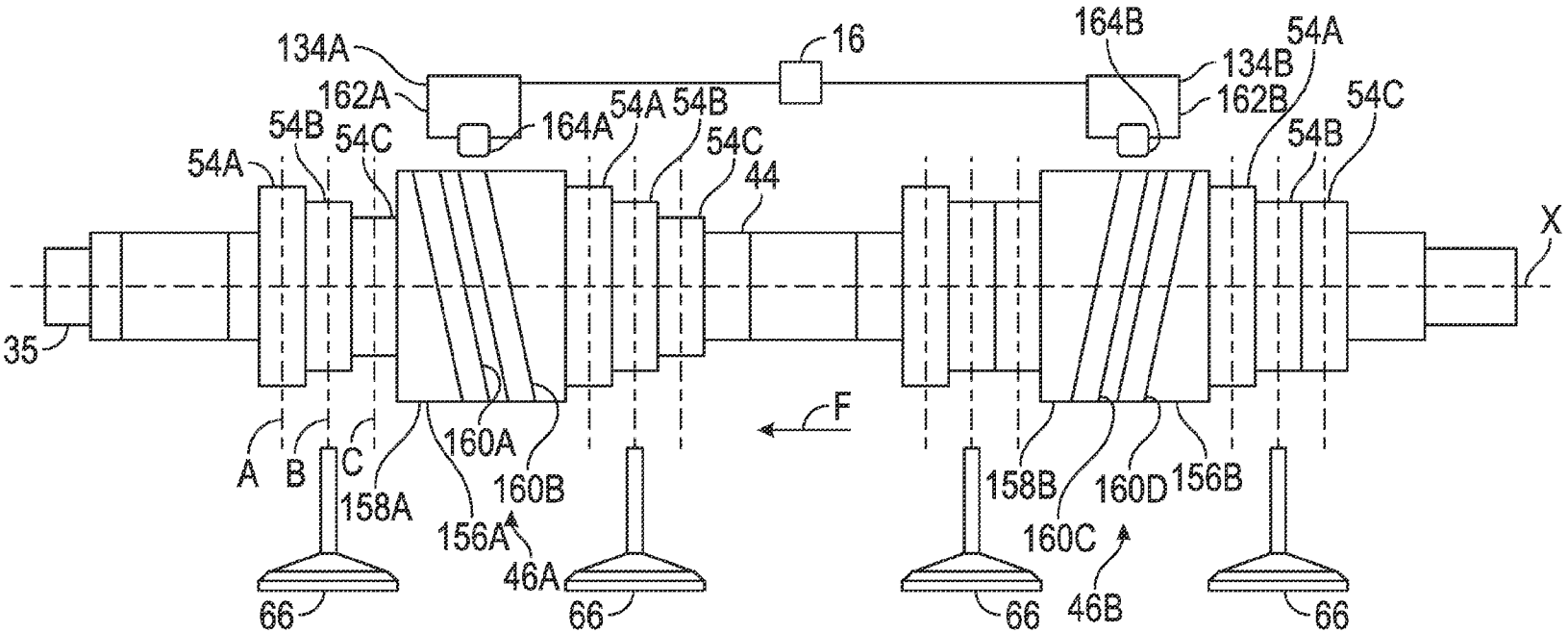
FIG. 17 is a schematic side view of the camshaft assembly shown in FIG. 13, showing the lobe packs in a second position.
Figure 19:
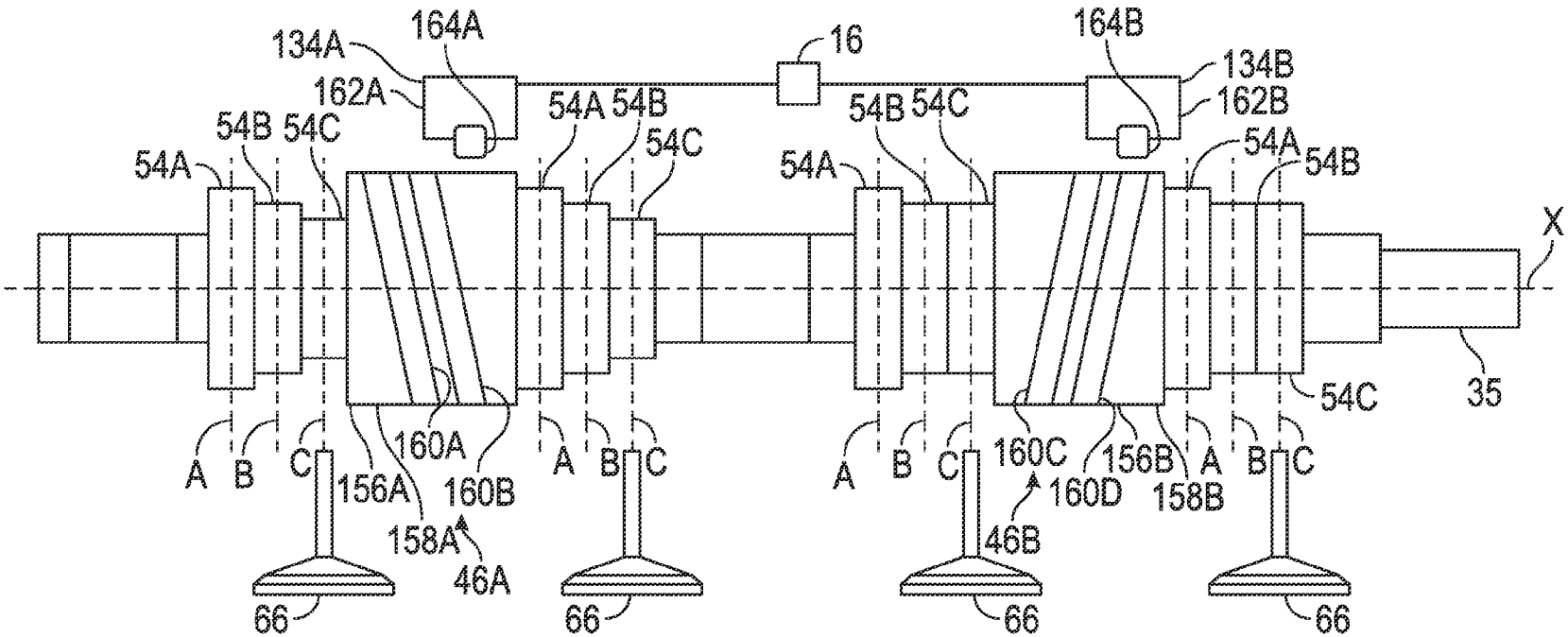
FIG. 19 is a schematic side view of the camshaft assembly shown in FIG. 13, showing the lobe packs in a third position.

The axially movable member 44 and lobe packs 46A, 46B of the camshaft assembly 133 can also move relative to the base shaft 35 between a first position (FIG. 13), a second position (FIG. 17), and a third position (FIG. 19). To move the axially movable member 44 from the first position (FIG. 13) to the second position (FIG. 17), the control module 16 can command the first actuator 134A to move the first pin 164A from the retracted position to the extended position while the base shaft 35 rotates about the longitudinal axis X as shown in FIG. 16. In the extended position, the first pin 164A is at least partially disposed in the first control groove 160A. The first control groove 160A is therefore configured, shaped, and sized to receive the first pin 164A when the first pin 164A is in the extended position. At this point, the first pin 164A of the first actuator 134A partially enters the first groove portion 168A (FIG. 14) of the first control groove 160A and then rides along the third groove portion 172A as the lobe packs 46A, 46B rotate about the longitudinal axis X. As the first pin 164A rides along the third groove portion 172A (FIG. 14) of the first control groove 160A, the axially movable member 44 and the lobe packs 46A, 46B move axially relative to the base shaft 35 from the first position (FIG. 13) to the second position (FIG. 17) in the first direction F. The first pin 164A of the first actuator 134A will be retracted mechanically by the first control groove 160A. After the lobe packs 46A, 46B have moved, the depth of the first control groove 160A is reduced in order to return the first pin 164A back to the retracted position. Alternatively, the control module 16 can command the first actuator 134A to move the first pin 164A to the retracted position.

Figure 18:
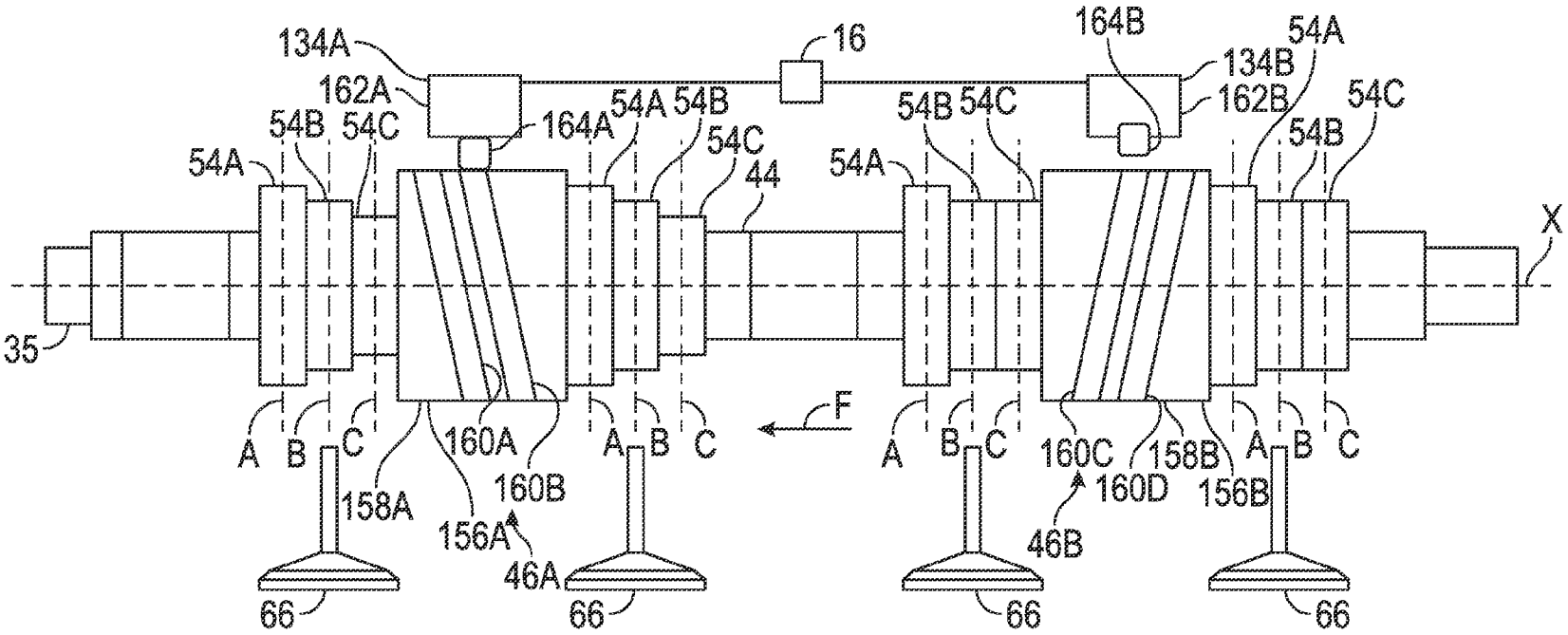
FIG. 18 is a schematic side view of the camshaft assembly shown in FIG. 13, showing the pin of the first actuator partially disposed in the second control groove of the first barrel cam.

To move the axially movable member 44 from the second position (FIG. 17) to the third position (FIG. 19), the control module 16 can command the first actuator 134A to move the first pin 164A from the retracted position to the extended position while the base shaft 35 rotates about the longitudinal axis X as shown in FIG. 18. In the extended position, the first pin 164A is at least partially positioned in the second control groove 160B. The second control groove 160B is therefore configured, shaped, and sized to receive the first pin 64A when the first pin 164A is in the extended position. At this point, the first pin 164A of the first actuator 134A partially enters the first groove portion 168B (FIG. 14) of the second control groove 160B and then rides along the third groove portion 172B (FIG. 14) as the lobe packs 46A, 46B rotate about the longitudinal axis X. As the first pin 164A rides along the third groove portion 172B (FIG. 14) of the second control groove 160B, the axially movable member 44 and the lobe packs 46A, 46B move axially relative to the base shaft 35 from the second position (FIG. 17) to the third position (FIG. 19) in the first direction F. The first pin 164A of the first actuator 134A will be retracted mechanically by the second control groove 160B. After the lobe packs 46A, 46B have moved, the depth of the second control groove 160B is reduced in order to return the first pin 164A back to the retracted position. Alternatively, the control module 16 can command the first actuator 134A to move the first pin 164A to the retracted position.

Figure 20:
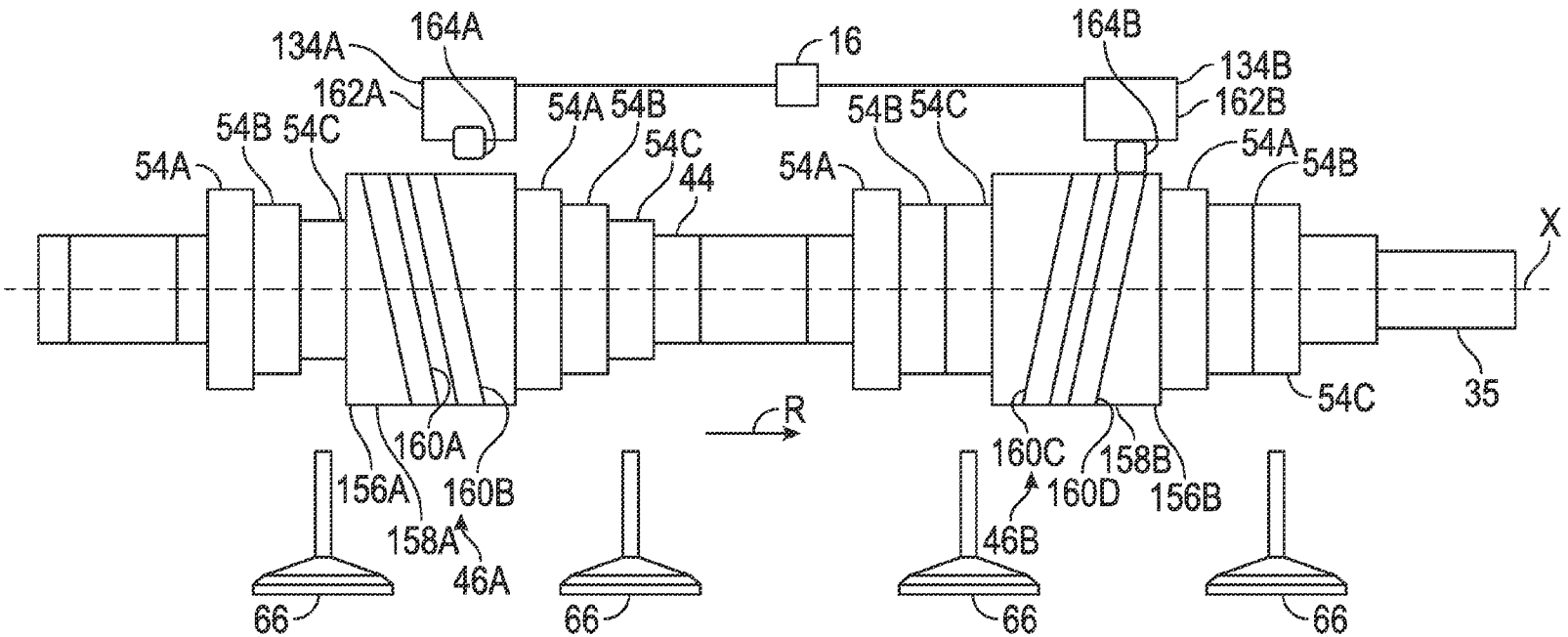
FIG. 20 is a schematic side view of the camshaft assembly shown in FIG. 13, showing a pin of the second actuator partially disposed in the second control groove of the second barrel cam.

To move the axially movable member 44 from the third position (FIG. 19) to the second position (FIG. 17), the control module 16 can command the second actuator 134B to move the second pin 164B from the retracted position to the extended position while the base shaft 35 rotates about the longitudinal axis X as shown in FIG. 20. In the extended position, the second pin 164B is at least partially positioned in the fourth control groove 160D. The fourth control groove 160D is therefore configured, shaped, and sized to receive the second pin 164B when the second pin 164B is in the extended position. At this point, the second pin 164B of the second actuator 134B partially enters the first groove portion 168D (FIG. 15) of the fourth control groove 160D and then rides along the third groove portion 172D (FIG. 15) as the lobe packs 46A, 46B rotate about the longitudinal axis X. As the second pin 164B rides along the third groove portion 172D (FIG. 15) of the fourth control groove 160D, the axially movable member 44 and the lobe packs 46A, 46B move axially relative to the base shaft 35 from the third position (FIG. 19) to the second position (FIG. 17) in the second direction R. The second pin 164B of the second actuator 134B will be retracted mechanically by the fourth control groove 160D. After the lobe packs 46A, 46B have moved, the depth of the fourth control groove 160D is reduced in order to return the second pin 164B back to the retracted position. Alternatively, the control module 16 can command the second actuator 134B to move the second pin 164B to the retracted position.

Figure 21:
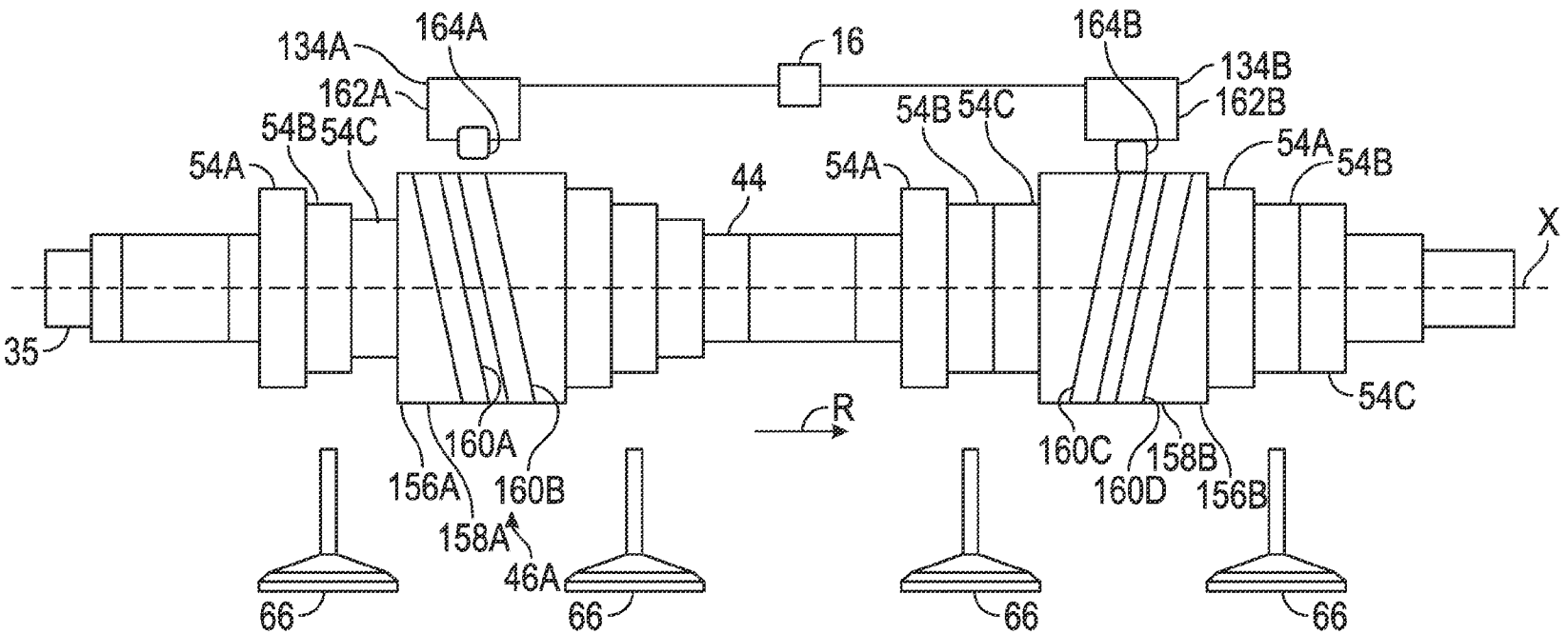
FIG. 21 is a schematic side view of the camshaft assembly shown in FIG. 13, showing the pin of the second actuator partially disposed in the first control groove of the second barrel cam.

To move the axially movable member 44 from the second position (FIG. 17) to the first position (FIG. 13), the control module 16 can command the second actuator 134B to move the second pin 164B from the retracted position to the extended position while the base shaft 35 rotates about the longitudinal axis X as shown in FIG. 21. In the extended position, the second pin 164B is at least partially positioned in the third control groove 160C. The third control groove 160C is therefore configured, shaped, and sized to receive the second pin 164B when the second pin 164B is in the extended position. At this point, the second pin 164B of the second actuator 134B partially enters the first groove portion 168C (FIG. 15) of the third control groove 160C and then rides along the third groove portion 172C (FIG. 15) as the lobe packs 46A, 46B rotate about the longitudinal axis X. As the second pin 164B rides along the third groove portion 172C (FIG. 15) of the third control groove 160C, the axially movable member 44 and the lobe packs 46A, 46B move axially relative to the base shaft 35 from the second position (FIG. 17) to the first position (FIG. 13) in the second direction R. The second pin 164B of the second actuator 134B will be retracted mechanically by the third control groove 160C. After the lobe packs 46A, 46B have moved, the depth of the third control groove 160C is reduced in order to return the second pin 164B back to the retracted position. Alternatively, the control module 16 can command the second actuator 134B to move the second pin 164B to the retracted position.

The detailed description and the drawings or figures are supportive and descriptive of the invention, but the scope of the invention is defined solely by the claims. While some of the best modes and other embodiments for carrying out the claimed invention have been described in detail, various alternative designs and embodiments exist for practicing the invention defined in the appended claims. As used herein, the phrase at least one of A and B should be construed to mean a logical (A or B), using a non-exclusive logical or.

The invention claimed is:

1. A camshaft assembly, comprising:

a base shaft extending along a longitudinal axis, the base shaft being configured to rotate about the longitudinal axis;

a lobe pack mounted on the base shaft, wherein the lobe pack comprises:

a first cam lobe;

a second cam lobe axially spaced from the first cam lobe;

a third cam lobe axially spaced from the first and second cam lobes; and a barrel cam defining a control groove, wherein the control groove includes a groove portion obliquely angled relative to the longitudinal axis; and an actuator including an actuator body and first and second pins movably coupled to the actuator body, each of the first and second pins being configured to move relative to the actuator body between a retracted position and an extended position;

wherein the lobe pack is configured to move axially relative to the base shaft between a first position and a second position when the base shaft rotates about the longitudinal axis and the first pin is in the extended position and at least partially disposed in the groove portion of the control groove; and wherein the lobe pack is configured to move axially between the second position and a third position when the base shaft rotates about the longitudinal axis and the second pin is in the extended position and at least partially disposed in the groove portion of the control groove.

2. The camshaft assembly of claim 1, further comprising a control module in communication with the actuator, wherein the first and second pins are configured to move between the retracted and extended positions in response to an input from the control module.

3. The camshaft assembly of claim 1, wherein the lobe pack is rotationally fixed to the base shaft.

4. The camshaft assembly of claim 1, wherein the first and second pins are configured to move independently of each other.

5. The camshaft assembly of claim 1, wherein the first cam lobe has a first maximum lobe height, the second cam lobe has a second maximum lobe height, and the first maximum lobe height is different from the second maximum lobe height.

6. The camshaft assembly of claim 5, wherein the third cam lobe has a third maximum lobe height, and the second maximum lobe height is equal to the third maximum lobe height.

7. The camshaft assembly of claim 5, wherein the third cam lobe has a third maximum lobe height, and the second maximum lobe height is different from the third maximum lobe height.

8. A camshaft assembly, comprising:

a base shaft extending along a longitudinal axis, the base shaft being configured to rotate about the longitudinal axis;

a lobe pack mounted on the base shaft, wherein the lobe pack includes:

a first cam lobe;

a second cam lobe axially spaced from the first cam lobe;

a third cam lobe axially spaced from the first and second cam lobes; and a barrel cam defining first and second control grooves, the first control groove including a first angled groove portion obliquely angled relative to the longitudinal axis, the second control groove including a second angled groove portion obliquely angled relative to the longitudinal axis; and an actuator including an actuator body and a pin movably coupled to the actuator body, the pin being configured to move relative to the actuator body between a retracted position and an extended position;

wherein the lobe pack is configured to move axially relative to the base shaft between a first position and a second position when the base shaft rotates about the longitudinal axis and the pin is in the extended position and at least partially disposed in the first angled groove portion of the first control groove; and wherein the lobe pack is configured to move axially relative to the base shaft between the second position and a third position when the base shaft rotates about the longitudinal axis and the pin is in the extended position and at least partially disposed in the second angled groove portion of the second control groove.

9. The camshaft assembly of claim 8, wherein the first and second control grooves do not intersect each other.

10. The camshaft assembly of claim 8, further comprising a control module in communication with the actuator, wherein the pin is configured to move between the retracted and extended positions in response to an input from the control module.

11. The camshaft assembly of claim 8, wherein the lobe pack is rotationally fixed to the base shaft.

12. The camshaft assembly of claim 8, wherein the first cam lobe has a first maximum lobe height, the second cam lobe has a second maximum lobe height, and the first maximum lobe height is different from the second maximum lobe height.

13. The camshaft assembly of claim 12, wherein the third cam lobe has a third maximum lobe height, and the second maximum lobe height is equal to the third maximum lobe height.

14. The camshaft assembly of claim 12, wherein the third cam lobe has a third maximum lobe height, and the second maximum lobe height is different from the third maximum lobe height.

15. A vehicle, comprising:

an internal combustion engine defining a combustion chamber and a port in fluid communication with the combustion chamber, the internal combustion engine further including a valve at least partially disposed in the port;

a base shaft operatively coupled to the internal combustion engine, the base shaft extending along a longitudinal axis, wherein the base shaft is configured to rotate about the longitudinal axis;

a lobe pack mounted on the base shaft, the lobe pack being configured to move axially relative to the base shaft between a first position, a second position, and a third position, wherein the lobe pack comprises:

a first cam lobe configured to be operatively coupled to the valve when the lobe pack is in the first position;

a second cam lobe axially spaced from the first cam lobe, wherein the second cam lobe is configured to be operatively coupled to the valve when the lobe pack is in the second position;

a third cam lobe axially spaced from the first and second cam lobes, wherein the third cam lobe is configured to be operatively coupled to the valve when the lobe pack is in the third position; and a barrel cam defining a control groove, wherein the control groove includes a groove portion obliquely angled relative to the longitudinal axis; and an actuator including an actuator body and first and second pins movably coupled to the actuator body, each of the first and second pins being configured to move relative to the actuator body between a retracted position and an extended position;

wherein the lobe pack is configured to move axially between the first and second positions when the base shaft rotates about the longitudinal axis and the first pin is in the extended position and at least partially disposed in the groove portion of the control groove; and wherein the lobe pack is configured to move axially between the second and third positions when the base shaft rotates about the longitudinal axis and the second pin is in the extended position and at least partially disposed in the groove portion of the control groove.

16. The vehicle of claim 15, further comprising a control module in communication with the actuator, wherein the first and second pins are configured to move between the retracted and extended positions in response to an input from the control module.

17. The vehicle of claim 15, wherein the lobe pack is rotationally fixed to the base shaft.

18. The vehicle of claim 15, wherein the first and second pins are configured to move independently of each other.

19. The vehicle of claim 15, wherein the first cam lobe has a first maximum lobe height, the second cam lobe has a second maximum lobe height, and the first maximum lobe height is different from the second maximum lobe height.

20. The vehicle of claim 19, wherein the third cam lobe has a third maximum lobe height, and the second maximum lobe height is equal to the third maximum lobe height.

* * * * *